US007464659B2

(12) United States Patent
Lemonides

(10) Patent No.: US 7,464,659 B2
(45) Date of Patent: Dec. 16, 2008

(54) APPARATUS FOR AFFIXING A DOCK TO A MOORING POLE

(76) Inventor: Dimitri Lemonides, 153 Jeffrey La., Oceanside, NY (US) 11572

( * ) Notice: Subject to any disclaimer, the term of this patent is extended or adjusted under 35 U.S.C. 154(b) by 9 days.

(21) Appl. No.: 11/699,181

(22) Filed: Jan. 29, 2007

(65) Prior Publication Data

US 2007/0137547 A1 Jun. 21, 2007

Related U.S. Application Data

(63) Continuation-in-part of application No. 11/026,791, filed on Dec. 31, 2004, now Pat. No. 7,188,579.

(51) Int. Cl.
*B63B 35/44* (2006.01)

(52) U.S. Cl. ..... 114/263; 405/219; 405/221

(58) Field of Classification Search ..... 114/263; 405/219, 221

See application file for complete search history.

(56) References Cited

U.S. PATENT DOCUMENTS 3,486,342 A * 12/1969 Aks ..... 405/212
3,997,150 A * 12/1976 Hanson et al. ..... 267/140
4,028,899 A 6/1977 Carmichael, III
4,286,897 A * 9/1981 Suskind ..... 405/221
4,357,891 A * 11/1982 Sluys ..... 114/230.27
4,923,336 A * 5/1990 Schmidt ..... 405/216
5,762,016 A 6/1998 Parsons
5,937,781 A * 8/1999 Isella et al. ..... 114/230.26
7,021,230 B1 4/2006 Lawrence
7,066,102 B1 6/2006 Tossaveinen
7,124,700 B1 10/2006 Impey
7,153,064 B2 * 12/2006 Zeilinger et al. ..... 405/221
7,188,579 B2 * 3/2007 Lemonides ..... 114/230.2

* cited by examiner

*Primary Examiner*—Sherman Basinger
(74) *Attorney, Agent, or Firm*—Richard L. Strauss, Esq

(57) ABSTRACT

An apparatus is disclosed especially configured and adapted for mooring a floating dock to a mooring pile. The apparatus minimizes damage to both dock and mooring piles caused by changes in tide, waves, wake and other water disturbances while, simultaneously, adding stability to the floating dock—especially in regarding to listing—. The apparatus is comprised of a cylindrical sleeve which is coaxially applied to a mooring pile, a dock mounted mooring bracket comprised of a base plate which connects to the sleeve mounted upon the pile via at least two "U" shaped arms which are disposed in a parallel, spaced-apart relation which engage selected and parallel circumferential grooves formed in the outer surface of the sleeve. The base plate, in turn, is affixed to a structurally sound portion of a dock such as a horizontally disposed plate. In further preferred embodiments, a buoyant base is affixed about the inferior terminus of the cylindrical sleeve to provide buoyancy thereto as well as buoyancy to the dock to which the apparatus is affixed.

34 Claims, 14 Drawing Sheets

APPARATUS FOR AFFIXING A DOCK TO A MOORING POLE

This application is a continuation-in-part of U.S. patent application Ser. No. 11/026,791 filed Dec. 31, 2004, now U.S. Pat. No. 7,188,579 the entire specification of which is hereby incorporated herein by reference.

TECHNICAL FIELD

The device and method disclosed herein relate generally to marine mooring systems. More specifically, the disclosed device and method of use thereof relates to enhanced utilization of mooring poles for securing floating docks.

BACKGROUND OF THE ART

It is well known that the mooring floating docks (and attachments thereto such as "fingers") to pilings is often complicated by changing tides. In some areas, such changes in tides—from low tide to high tide—may be so great as to cause great stress, friction and wear to both floating docks and the mooring poles which hold such docks in place. For example, a dock may be moored to one or more mooring piles utilizing chains, chain covered by PVC pipe segments or metal brackets. As tide levels cycle throughout the day, both dock and pile are subjected to wear and damage caused by the movement of each relative to the other. In addition, waves, wake and other water disturbances may cause additional damage to both pilings and docks by virtue of the impacts suffered therebetween. In addition, a floating dock secured to a mooring post may become dangerously tilted, damaged and/or capsized during tide changes if the means of securing the dock to the pile(s) does not allow for vertical movement along the pile(s) during such tide changes.

In regard to damage caused by movement between floating dock and mooring piles, such docks may be equipped with rubber molding, bumpers or other resilient materials designed to reduce such damage. However, the incessant changes in tide coupled with the action of waves and wakes, over time, will almost certainly cause the loss of such protective devices. Although such moldings and bumpers may be replaced, constant vigilance and maintenance is required due to the inherent deficiencies of such devices.

Floating docks are commonly constructed about a core of flotation material such as, for example, a foam material. With time, portions of such foam may break away, become saturated with water, or otherwise loose the buoyancy otherwise provided to the dock structure they support. As floatation material is either lost or damaged, the stability of the floating dock decreases thereby allowing the structure to list from one side to the other as weight, such as passengers entering into a boat, is applied to sides (and away from the midline) of such docks.

Even in regard to new docks, incorporating perfectly performing and placed buoyancy materials, listing does occur when substantial weight is applied along one side of the floating dock. Such listing also occurs, even in regard to docks whose total composition provides floatation (and which do not require separate floatation materials). Listing of floating docks can be dangerous in regards to the safety of passengers embarking and disembarking boats tied to such docks. In addition, equipment, food and other provisions placed in the vicinity of the edge of the dock may be lost during such listing d reasonable amount of mooring line at low tide, only to be allowed to drift dangerously far from such anchorage as the tide rises.

U.S. patent application Ser. No. 11/026,791 (the "791 APPLICATION") discloses a mooring pole line attachment device providing safe mooring of a boat or other marine vehicle to a mooring pole by continually adjusting the height of line attachment points thereupon with changes in water level. In addition, the mooring pole line attachment device disclosed in the '791 application provides protection of mooring poles from rough contacts with boats moored thereto, while simultaneously affording protection to the boats. The mooring pole line attachment device is comprised of a buoyant base, cylindrical sleeve and at least one line engagement means.

The buoyant base is tubular in configuration and includes an outer surface and an internal core surrounding and defining a central bore. The core of the buoyant base includes an inner circumferential coiled tube (similar to the columnar sleeve, but of a more diminutive diameter. The coiled tube within the base includes an outer surface which is configured to demonstrate parallel grooves and rings similar to that found upon the outer surface of the cylindrical sleeve. The coiled tube is positioned and aligned to lie circumferentially about the proximal (or inferior) termini of the cylindrical sleeve. The coiled tube defines a central bore of a dimension sufficient so as to allow the sleeve—as discussed immediately above—to fit therewithin, substantially flush with the proximal (inferior) terminus thereof. Thus, the parallel rings and grooves formed on the surface of the buoyant base are aligned generally perpendicular to the parallel rings and grooves of the cylindrical sleeve. The outer surface of the buoyant base is advantageously covered by a tough, resilient cover, such as, for example, a polyvinyl, polyester or nylon composition. The cover may be fabricated of one or more sections and tied (or otherwise affixed) to the outer surface of the buoyant base. The inner core of the buoyant base is comprised of a buoyant structure such as, for example, a circumferential polyethylene, polyvinyl or polyester hollow tube positioned within the core. Additionally, the core of the buoyant base is filled with a buoyant material such as, for example, a polystyrene foam thereby imparting great buoyancy to the base.

As mentioned above, the buoyant base defines a substantially tubular, or, as it may be better described, a "donut-like" shape including an inner bore. The inner bore of the buoyant base is affixed to a proximal terminus of the cylindrical sleeve of the device. The cylindrical sleeve is comprised of a hollow tubular structure with an outer surface and an inner surface defining a central bore. The outer surface of the cylindrical sleeve is shaped and configured to include a plurality of continuous parallel grooves arranged circumferentially about said outer surface. In contrast, the inner surface of the cylindrical sleeve defines a relatively smooth surface. The cylindrical sleeve may be fabricated of any marine quality material such as, for example, a polyvinyl, polyether or polyester plastic. The sleeve may be also fabricated from a natural rubber or a synthetic rubber such as, for example, a nitrile rubber. The cylindrical sleeve includes a proximal and distal terminus. The proximal terminus of the sleeve and the inner bore of the buoyant base are especially configured so that the outer surface of the columnar sleeve will mate with the central bore of the base thereby allowing ease of fixation of the base to the proximal terminus of the tube via, for example injection and curing of the above-described polystyrene core material into the base during fabrication of the device (discussed in greater detail below).

The smooth inner surface of the cylindrical sleeve (and the central bore defined thereby) are especially sized and configured so as to allow the device (with cylinder attached to base) to slide easily over a mooring pole. The smooth inner surface of the cylindrical sleeve runs from the proximal (or inferior) to the distal (or superior) terminus of the device thereby allowing the entire device to be placed upon and slide up and down a mooring pole.

The annular (or parallel circumferential) grooves of the cylindrical sleeve serves two distinct purposes. During the fabrication of the mooring pole device, the outer surface of the sleeve is passed through the buoyant base section prior to injection of foam therein. At this point in the fabrication process, the buoyant base includes the above-described outer cover, an inner circumferential coiled tube (similar to the columnar sleeve, but of a more diminutive diameter). The coiled tube within the base defines a central bore of a dimension sufficient so as to allow the sleeve to fit therewithin, substantially flush with the proximal (inferior) terminus thereof. Thereafter, polystyrene (or other suitable buoyant) foam is injected into the base an fills both the base and the outer annular rings of the sleeve thereby effectively affixing one to the other. Thus the central bore of the sleeve becomes the central bore of the entire device.

The annular rings of the sleeve also provide line tied points of varying heights (in regard to water level) so as to accommodate boats of varying sizes and freeboard dimension. For example, and as shown in greater detail below, the device of the present invention may include a line engagement means comprised of an adjustable rope tied circumferentially about a selected annular groove. The adjustable rope is configure to include one or more loops through which mooring lines may be past in order to secure a boat. The adjustable rope is tied so as to allow it to be moved superiorly or inferiorly along the outer sleeve so as to accommodate the afore-mentioned varying boat dimensions.

The device disclosed in the '791 application may optionally include a mooring line storage device such as, for example, a simple velcro or snap lock nylon strap affixed near the superior portion of the device so as to allow mooring lines to be left high and dry at the pole.

The device disclosed in the '791 application is prepared for use as follows. The device is slid down upon a mooring pole, the central bore of the device being configured to fit about such a pole. Upon contact of the buoyant base with water surrounding the pole, the device begins to float. Thereafter, an annular ring is selected for placement of the afore-mentioned adjustable rope. Thereafter a mooring line may be attached to the adjustable rope. As the tide level changes, the device rises and lowers to accommodate such changes. However, the relative vertical positions of the annular ring (tie point) of the present device, and the position of a boats engaged cleats will not change. Therefore, changes in tides will not result in any stress or strain on mooring lines, boats or pilings. In addition, the cylindrical sleeve is highly efficient at protecting both boat and piling from collisions therebetween due to the fact that the sleeve circumferentially covers the pole and rises and falls with changing tides.

SUMMARY OF THE INVENTION

Now in accordance with the present invention, an apparatus is disclosed for affixing a floating dock to a mooring pile especially configured and adapted to minimize damage to both dock and mooring piles caused by changes in tide, waves, wake and other water disturbances while, simultaneously, adding stability to the floating dock. The apparatus of the present invention is comprised of a cylindrical sleeve, a dock mooring bracket and a means for affixing the mooring bracket to a floating dock. As described in greater detail below, the apparatus of the present invention provides a secure means for mooring a floating dock to one or more pilings located adjacent to the floating dock. The apparatus of the present invention greatly minimizes damage to both floating docks and pilings caused by the aforementioned water disturbances and changes in water level. It also increases the stability of the dock in regard to listing (associated with wave action or uneven application of weight, as discussed above).

The cylindrical sleeve of the present invention is a tubular structure having an outer surface, an inner surface, proximal and distal termini. The sleeve is configured to include a central bore therewithin extending throughout the length of the sleeve. The central bore is especially configured to demonstrate a diameter especially selected to allow the bore to receive (and the sleeve to be place coaxially upon) a piling having a given outside diameter and length. The selected bore diameter allows the sleeve, as described in more detail, below, to move up an down along the length of the piling—without binding—while, at the same time, is selected to closely adapt to the piling in order to minimize lateral movement of the sleeve when placed coaxially upon such a piling. However, sufficient clearance must be provided for movement—without interference—of the sleeve along the length of the pile. Such a configuration allows the cylindrical sleeves, as discussed above and below, to be coaxially slipped over a mooring pile adjacent to a floating dock.

The outer (or outside) surface of the cylindrical sleeve is configured to include a plurality of circumferential parallel rings and grooves. Thus, the circumferential parallel rings and grooves are oriented perpendicular to the long axis of the sleeve. It is especially advantageous to configure the cylindrical sleeves with parallel grooves running along the entire length of the cylindrical sleeve. In contrast to the outside surface, the inner surface of the cylindrical sleeve (defining the central bore), exhibits a smooth surface to facilitate movement along the length of a mooring pile. The cylindrical sleeve may be fabricated of any marine quality material such as, for example, a polyvinyl, polyether or polyester plastic. The sleeve may be also fabricated from a natural rubber or a synthetic rubber such as, for example, a nitrile rubber.

In certain preferred embodiments of the present invention the apparatus further comprises a buoyant base (disclosed in more detail below) affixed to the cylindrical sleeve. In such embodiments, the outside diameter of the sleeve and the diameter of the inner bore of the buoyant base are especially configured so that a proximal portion of the outer surface of the cylindrical sleeve will fit coaxially within and mate with the central bore of the buoyant base. Such a configuration allows ease of fixation of the buoyant base to the proximal terminus of the cylindrical tube via, for example, injection and curing of polystyrene core material into the base during fabrication of the device (discussed in greater detail above and below). The buoyant base includes sufficient buoyant material therewithin so as to enable all of the cylindrical sleeve, disposed superior (or distal) to the superior terminus of the buoyant base to lie above the water line when the apparatus is coaxially applied to a mooring pile. Such buoyancy is of great assistance in assuring that all of the parallel circumferential grooves, superior (distal) to the superior (distal) terminus of the buoyant base will be available for positioning of the below described "U" shaped arms.

As also described in greater detail, below, embodiments of the present invention incorporating the afore-mentioned buoyant base may, via the buoyancy provided by the buoyant base of the present apparatus, provide a means of enhancing the buoyancy of a floating dock to which the apparatus is affixed. In other embodiments, wherein a floating dock may not incorporate any, or sufficient floatation material, to enable the dock to float, the buoyancy provided by the buoyant base alone is utilized to provide floatation to the dock of the apparatus to which the dock is affixed may provide the sole means of providing floating to the dock. In addition to floatation, the buoyant base also provides further protection of the mooring pilings and docks to which they are affixed from collision with boats and other floating structures.

As discussed above, the smooth inner surface of the cylindrical sleeve (and the central bore defined thereby) are especially sized and configured so as to allow the device (with or without the cylinder attached to a buoyant base) to closely a adapt to, yet still slide easily over a mooring pole. The smooth inner surface of the cylindrical sleeve runs from the proximal (or inferior) to the distal (or superior) terminus of the device thereby allowing the entire device to be placed upon and slide coaxially, along the length of a mooring pole. It is preferred that, in order to achieve such close adaptation of sleeve to pile, that the inside diameter of the cylindrical sleeve be from about 1.0 inches to about 4 inches larger than the outside diameter of a pile to which it is applied. It is still further preferred that the inside diameter of the cylindrical sleeve be from about 1.5 inches to about 3 inches larger than the outside diameter of the cylindrical sleeve.

The parallel grooves formed upon the external surface of the cylindrical sleeve serve two purposes. Firstly, the grooves form engagement sites for receipt of the at least two "U" shaped arms of the dock mooring bracket (discussed in detail below). Secondly, the rings and grooves also provide points for attachment of mooring lines to boats moored alongside a floating dock utilizing mooring piles upon which the apparatus of the present invention is placed for mooring of the floating dock (rather than tying such boats to the floating dock). The parallel grooves and grooves are, of course, parallel in configuration to each other and are aligned perpendicular to the long axis of the sleeve. As mentioned above, the inner bore of the cylindrical sleeve is selected to closely adapt to a pile upon which it is placed. As discussed below, the "U" shaped arms are similarly disposed perpendicular to the base plate to which they are affixed, are parallel to one another, and are spaced apart (as discussed below), when the apparatus of the present invention is affixed to a floating dock. This configuration of fit and parallelism allows a dock—moored to a piling by the apparatus—to rise and fall with changing tide levels while simultaneously resisting listing movements of the dock in reaction to water currents, wake and other disturbances.

The dock mooring bracket is comprised of at least two "U" shaped arms, a base plate, a means of affixing the arms to the plate and a means of affixing the base plate to a floating dock. It is preferred that the base plate be fabricated of a corrosion resistant or non-corroding metal such as, for example, galvanized steel, aluminum or stainless steel. However, it is also contemplated that the base plate may be fabricated of a metal protected against corrosion (oxidation) via a corrosion resistant finish such as, for example, a powder coat paint. It is also contemplated that a high strength composite material such as, for example, a filled plastic resin, fiberglass or carbon fiber composite material may be utilized to form the plate.

The base plate may be described as having an inside face and an outside face. The inside face (or inner face) of the base plate is that surface of the plate mounted upon and in contact with a portion of a floating dock to which the bracket is affixed (as discussed in more detail, below. The outside face of the bracket is that surface of the base plate ordinarily facing and in contact with a cylindrical sleeve to which the bracket is mounted. It is highly advantageous, in embodiments of the present invention wherein the "U" shaped bolts are affixed to the base plate via nuts and washers, to form a recess—a bolt recess—within the inside face of the base plate so, as described in greater detail below, to allow the "U" shaped brackets to be affixed to the plate with nuts and bolts without either the brackets or fasteners (nuts and bolts) from extending beyond the surface of the inside face. This arrangement facilitates flush mounting of the base plate to a relatively flat dock mounting surface. Regardless of the means of affixing the "U" shaped arms to the plate, in preferred embodiments of the present invention, the "U" shaped arms are disposed in a perpendicular manner to the plate, the arms are parallel to one another, and are spaced apart. This configuration—in combination with the close adaptation of the sleeve to the piling and the parallel grooves provided on the surface of the sleeve, as discussed above, enhances the ability of the apparatus to provide stability to a floating dock against listing It is also preferred that the at least two "U" shaped arms also be fabricated of a corrosion resistant or non-corroding metal such as, for example, galvanized steel, aluminum or stainless steel.

The base plate may be advantageously configured as a square or rectangular shaped plate (having a relatively flat profile) fabricated of any of the above-mentioned materials. However, the base plate may also be formed in other shapes in order to allow the plate to be securely placed against and secured to a floating dock. The base plate is configured to include at least two and preferably four anchor bolt receiving holes passing therethrough for receipt of anchor bolts, anchor screws or other fastening devices utilized as the means of affixing the base plate to the floating dock (as discussed in more detail, below). It is preferred that these affixing means also be fabricated from a corrosion resistant metal such as, for example, galvanized steel, brass or stainless steel.

In certain preferred embodiments of the present invention, the base plate also includes at least two pairs of "U" shaped arm receiving holes provided as a means of mounting the at least two "U" shaped arms (discussed below), to the base plate. However, the bracket may include additional pairs of "U" shaped arm receiving holes in order to provide greater flexibility in selection of bracket mounting positions and/or the use of more than two "U" shaped arms.

Regardless of the number of pairs of receiving holes selected, each pair must be prepared so that the "U" shaped arms affixed to the plate therethrough will be disposed parallel to one another as well as substantially parallel to the surface of the water in which the floating dock is moored. Thus the arm receiving holes must be prepared so that a line drawn between the center of any pair of "U" shaped arm receiving holes and a line drawn between the center of any other pair of such "U" shaped arm receiving holes are parallel to one another. Also, when the plate is affixed to a dock, these lines will be parallel to the surface of the dock and the surface of the water in which the dock is moored. Thus, "U" shaped arms affixed to the base plate which, in turn, is affixed to a dock will be disposed parallel to one another, the top surface of the dock (substantially parallel to the surface of the water). The arms will also be disposed in a parallel relation to the circumferential grooves of a cylindrical sleeve of the present invention placed upon a piling, adjacent to the dock, which is plumb. The aforementioned parallel arrangement of the top surface of the dock, each pair of "U" shaped arm receiving holes, "U" shaped arms and the circumferential grooves of the cylindrical sleeve enhances the ability of the sleeve to move up and down along a piling upon which it is placed during changes in tide level—without binding—while also resisting listing of the dock which the apparatus moores. The aforementioned parallel relation of the "U" shaped arms is achieved in preferred embodiments of the present invention regardless of the manner (e.g. nuts/washers, bolts or integral fabrication) in which the "U" shaped arms are affixed to the plate.

As discussed above, the mooring bracket includes at least two "U" shaped arms especially configured and adapted to engage at least two circumferential parallel grooves of the cylindrical sleeve. Thus, the at least two "U" shaped arms are configured, arranged and mounted upon the base plate in such a manner as to enable engagement of two adjacent parallel grooves of the cylindrical sleeve. However, the present invention contemplates embodiments wherein the at least two "U" shaped arms are configured, arranged and mounted upon the base plate in such a manner as to engage parallel, but non-adjacent parallel grooves as well (wherein interceding grooves of the cylindrical sleeve intervene between grooves engaged by the "U" shaped arms.

The "U" shaped arms may be described as terminating with two terminal ends (or termini), and include, at a portion of the arms therebetween, a curved "semi-circular" portion. The curved "semi-circular" portion is configured to demonstrate an inside diameter configured to closely adapt to an enable the arm to tightly engage a selected circumferential groove located on the sleeve. In certain preferred embodiments of the present invention, the termini of the "U" shaped arms are externally threaded as a means for engagement to the base plate via nuts and washers. However, it is also contemplated, in other preferred embodiments of the present invention, that the termini of the "U" shaped arms are affixed directly to the base plate via bonding, welding or one-piece construction wherein the "U" shaped arms and base plate are fabricated as one continuous unit.

As discussed above, the at least two "U" shaped arms are affixed to the base plate in such a manner and in such an orientation as to enable the at least two "U" shaped arms to engage both adjacent and non-adjacent circumferential parallel grooves of the cylindrical sleeve. Thus, the "U" shaped arms are mounted, upon the base, in such a manner as to position the "U" shaped arms parallel to one another. Thus, in preferred embodiments of the present invention, the intervening space between the "U" shaped arms will be substantially equal to the space between two adjacent parallel grooves or, in other embodiments, the space between non-adjacent parallel grooves engaged by the "U" shaped arms.

The "U" shaped arms are formed to demonstrate an inside diameter, that allows the "U" shaped arms to closely adapt to, engage and lie within the parallel grooves of the cylindrical sleeve. As discussed below, the close adaptation of the "U" shaped arms within the grooves of the cylindrical sleeve enables the apparatus of the present invention to provide great stability to a dock utilizing such apparatus for mooring as against listing in reaction to water movement.

The at least two "U" shaped arms may be affixed to the base plate in a permanent manner, such as, for example, by welding the arms directly to the base plate or forming the "U" shaped arms and base plate together as one unit in an "integral, one piece construction". However, in embodiments utilizing welding or one piece construction, the at least two "U" shaped arms must be engaged about a cylindrical sleeve prior to such welding since, as described above, the "U" shaped arms are configured, affixed and arranged upon the base plate so as to firmly engage the parallel grooves of the cylindrical sleeve—engagement that prevents movement of the dock mooring bracket along the length of the sleeve—mounted to the base plate. In regard to embodiments of the present invention utilizing one piece bracket construction, such embodiments must be configured to include greater clearance between the "U" shaped arms and the parallel grooves of the sleeve so as to enable the brackets to be placed over the sleeve. Thus, certain alternate preferred embodiments must further comprise a means for tightening the "U" shaped arms engagement of the parallel grooves after such placement.

In the first preferred embodiment of the present invention, the at least two "U" shaped arms are affixed to the mounting plate via conventional nuts and washers. In such embodiments, "U" shaped arm receiving holes are provided with the mounting plate and are positioned so as to receive the two free end termini of the "U" shaped arms. In such embodiments, the two termini of the "U" shaped arms include external threads for mating engagement of both screw-type fasteners such as, for example, nuts as well as non-screw type fasteners such as, for example, washers. More specifically, in the first preferred embodiment of the present invention, the external threads of the two proximal termini of the "U" shaped arms are engaged with corresponding nut fasteners followed by a washer prior to passing the proximal termini through corresponding "U" shaped arm receiving holes and, after passing through said receiving holes, an additional washer and nut is affixed to said termini so as to firmly engage each arm to the bracket. As discussed above and below, the placement of the arm receiving holes in combination with the adjustment and fixation provided by nuts and washers allow the "U" shaped arms to align with and firmly engage parallel grooves of a cylindrical sleeve. The "U" shaped arm receiving holes are thus positioned so that, upon fixation of the at least two "U": shaped arms thereto, the arms will be arranged and configured for capture of at least two parallel (adjacent or non-adjacent) parallel grooves of the cylindrical tube. Therefore, the receiving holes for each of the "U:" shaped arms will be parallel to the receiving holes for each additional "U" shaped arm.

In embodiments of the present invention wherein externally threaded "U" shaped arms are affixed to the mounting plate via washers and nuts, the pile capture area defined by the area within and bordered by the "U" shaped arms and base plate may be easily adjusted by simply rotating the subject nuts proximally, to increase the area (to loosen the bracket's engagement of the sleeve), and distally, to reduce the area (and increase the bracket's engagement of the sleeve).

For example, the curved portion of the two or more "U" shaped arms may initially be slipped into, so as to engage a pair of adjacent (or nonadjacent) circumferential parallel grooves. Thereafter, a nut, followed by a washer, especially selected to mate with the external threads formed on the proximal termini of the "U" shaped arms are threaded and slipped (respectively) onto each of the two termini of the each arm. Thereafter, each of the termini of the "U" shaped arms are introduced into and passed through corresponding "U" shaped arm receiving holes located in the base plate. Thereafter, a second set of washers and nuts are placed upon the termini of the "U" shaped arms. Therefore, one nut and washer is then positioned proximal to the base plate and one nut and washer is positioned distal to the base plate. Rotation of the nuts and screws proximally, towards the termini of the "U" shaped arms then provides the largest possible pile capture area defined by the "U" shaped arms and base plate. In this configuration, the bracket may be easily manipulated in regard to a cylindrical sleeve regardless as to whether or not the cylindrical sleeve has been placed upon a mooring pile. However, advancing the nut and washes distally, towards the curved distal portion of the "U" shaped arms will also advance the base plate towards the cylindrical sleeve. Such movement may be continued distally in order to obtain a tight and secure fit of the bracket to the cylindrical sleeve (and pile therewithin if sleeve is already placed upon pile.) After the nuts and washers have been so advanced to enable the aforementioned secure fit, the nuts and washers located distal to the base plate may be advanced proximally, so as to provide a secure fixation of the "U" shaped arms to the base plate.

As discussed above, the aforementioned procedure for affixing the dock mooring bracket to a cylindrical sleeve may be utilized either before or after the central bore of the cylindrical sleeve is placed over a piling utilized for mooring a floating dock. In addition, the aforementioned assembly procedure is equally applicable to embodiments of the present invention wherein the cylindrical sleeve is affixed to a buoyant base as well as embodiments in which a buoyant base is not utilized.

As discussed above, the base plate includes two, and preferably four or more anchor bolt receiving holes for receipt of anchoring means. More specifically, the means for affixing the bracket to a floating dock may include machine bolts, lag bolts, U bolts, screws or any combination thereof wherein such fasteners are passed through the anchor bolt receiving holes and thereafter are affixed to suitably prepared receiving holes provided within the structure of the floating dock itself. For example, properly sized and placed pilot holes may be prepared within the material comprising the floating dock. Thereafter, a lag bolt may be passed through each of the anchor bolt receiving holes of the base plate and thereafter be driven into the pilot holes. Alternatively, bolt receiving holes may be prepared within the floating dock and thereafter machine bolts are passed through each of the anchor bolt receiving holes of the base plate and through the bolt receiving holes prepared in the dock. Thereafter, conventional washers and bolts are utilized to secure the bolts, and the brackets to which they are attached, to the floating dock. In any event, and, as discussed above, the base plate is mounted upon a dock so that each pair of "U" shaped arm receiving holes, and an arm mounted therewithin, will be parallel to the surface of the water in which the dock lies.

In embodiments of the present invention wherein the "U" shaped arms are affixed to the base plate via nuts and bolts (as described above) the apparatus of the present invention is utilized as follows. Initially, a floating dock having at least one adjacent mooring piles is identified. Thereafter, the cylindrical sleeve, described above, is, placed over the pile. In embodiments of the present invention wherein the cylindrical sleeve does not additionally comprise a buoyant base, the cylindrical sleeve is temporarily affixed to the pile with, for example, a nail or screw, until the below-described mounting is completed. In such instances, it is preferred that the sleeve be affixed to the mooring pole so that the inferior termini of the sleeve (closest to the bottom of the pile) is located approximately 2 to 5 feet inferior to and below the most inferior portion of the bracket base plate (when mounted upon the dock). However, it is most preferred that the sleeve is temporarily affixed to the pile at such a point as to enable the inferior termini of the sleeve to be located 2.5 feet below the water line of the floating dock. However, such distances are subject to any particular floating dock being located in an area exhibiting more than 2.5 feet water depth during extreme low tide.

After the sleeve has been temporarily affixed to the pile, at least two parallel grooves are selected to be engaged by the bracket. Thereafter, the at least two "U" shaped arms are placed about the sleeve so as to engage and lie within the selected grooves. Thereafter, one nut and one washer is threaded onto each of the externally threaded termini of the at least two "U" shaped arms and advanced, distally, towards the sleeve. Thereafter, the termini of the at least two "U" shaped arms are passed through their respective "U" shaped arm receiving holes. A washer and thereafter a nut are thence threaded upon and advanced distally along each of the proximal termini of the at least two "U" shaped arms until they bias against and advance the base plate firmly against the cylindrical sleeve. Thereafter, the nuts and washers located distal to the plate are advanced proximally, against the opposite face of the base plate so that the at least two "U" shaped arms are firmly affixed to the base plate. The "U" shaped arms are especially configured to exhibit a dimension so that, when they have firmly engaged selected parallel grooves of the cylindrical sleeve and are adjusted—via the aforementioned nuts and washers—so as to firmly engage the sleeve, the termini of each such arm do no extend beyond the aforementioned bolt recess located within the inner face of the bracket and so the termini lie within or flush with the inner face of the plate. In this way, the bracket may be mounted flush against a relatively flat mounting area (located on a floating dock) without the termini or fixation means of the "U" shaped brackets interfering with such placement.

The base plate may, as discussed above, now be affixed to the floating docks utilizing lag bolts, machine bolts, U bolts or other fasteners which pass through the at least two and preferably 4 anchor bolt receiving holes of the base plate to engage the portion of floating dock upon which the bracket is mounted. However, it is preferred that any such fasteners be fabricated of corrosion resistant or non-corroding materials such as, for example, stainless steel, galvanized steel or brass.

As mentioned above, certain preferred embodiments of the present invention include a buoyant base affixed proximate to the inferior terminus of the cylindrical sleeve. The buoyant base is tubular in configuration and includes an outer surface and an internal core surrounding and defining a central bore. The core of the buoyant base includes an inner circumferential coiled tube—an inner coil—(similar to the columnar sleeve, but of a more diminutive diameter and forming a closed circle). The inner coil includes an outer surface which is configured to demonstrate parallel grooves and rings similar to that found upon the outer surface of the cylindrical sleeve.

The inner coil is coiled about (circumscribes) and forms what may be described as the central bore of the buoyant base. This central bore is configured to have a dimension sufficient so as to a proximal portion of the cylindrical sleeve to fit therewithin. The inner coil is thus disposed circumferentially and perpendicular to the cylindrical sleeve. In this configuration, a portion of the parallel rings and grooves formed on the surface of the inner coil of the buoyant base are in contact with and aligned generally perpendicular to the parallel rings and grooves of that portion of the cylindrical sleeve passing through the bore of the buoyant base.

The outer surface of the buoyant base is advantageously covered by a tough, resilient cover, such as, for example, a polyvinyl, polyester or nylon composition. The cover may be fabricated of one or more sections and tied (or otherwise affixed) to the outer surface of the buoyant base. The inner core of the buoyant base is comprised of example, a circumferential polyethylene, polyvinyl or polyester hollow tube positioned within the core. Additionally, the core of the buoyant base is filled with a buoyant material such as, for example, a polystyrene foam thereby imparting great buoyancy to the base. In preferred embodiments of the present invention utilizing a buoyant base, the buoyant material utilized within the base demonstrates sufficient buoyancy so as to assure that the entire length of the cylindrical sleeve distal (superior) to the distal (superior) terminus of the base lies above the water line when the apparatus is applied to a pile.

In embodiments of the present invention including a buoyant base, it is preferred—but not required—that the buoyant base be located from about 2 to about 5 feet from the inferior terminus of the sleeve. This configuration allows the buoyant base to aid in enhancing the buoyancy of the floating dock to which the cylindrical sleeve is affixed while, simultaneously serving as an additional shock absorber between dock and piling.

As mentioned above, the apparatus of the present invention is especially configured for floating docks wherein the height of the dock, relative to adjacent pilings, is subject to change in accordance with changing tides, water levels, etc. As also mentioned above, the present invention also provides, with embodiments incorporating a buoyant base mounted upon the cylindrical sleeve, a means of increasing dock buoyancy to a floating dock as well as providing buoyancy to a dock not including, as an integral part of such dock, a buoyancy means sufficient to provide suitable floatation thereto.

The inner bore diameter of the coaxially mounted cylindrical sleeve, although closely adapted to the pile upon which it is placed, allows the sleeve to easily move up and down a mooring pile upon which it is placed, changes in water levels, causing a floating dock moored to a piling by means of the apparatus of the present invention, results in a simple, relatively smooth and non-traumatic upward and downward traverse of the sleeve along the pile. It is preferred that, in order to achieve such close adaptation of sleeve to pile, that the inside diameter of the cylindrical sleeve be from about 1.0 inches to about 4 inches larger than the outside diameter of a pile to which it is applied. It is still further preferred that the inside diameter of the cylindrical sleeve be from about 1.5 inches to about 3 inches larger than the outside diameter of the cylindrical sleeve. It is still further preferred that the inside diameter of the cylindrical sleeve be from about The apparatus of the present invention thereby avoids listing, capsizing and other disturbances caused to floating docks by other means of anchoring same to piles. In addition, engagement of two or more parallel groove of the cylindrical sleeve the two or more "U" shaped arms of the mooring bracket greatly reduces listing of the floating dock due to wave/wake action or uneven loading of the dock. Since, as described in greater detail below, the two or more "U" shaped arms are firmly engaged, on a distal portion thereof, within parallel grooves of a coaxially placed cylindrical sleeve and, on a proximal portion thereof, to a base plate of the bracket firmly bolted to the dock, the bracket slips listing of the floating dock.

DETAILED DESCRIPTION

Figure 1:
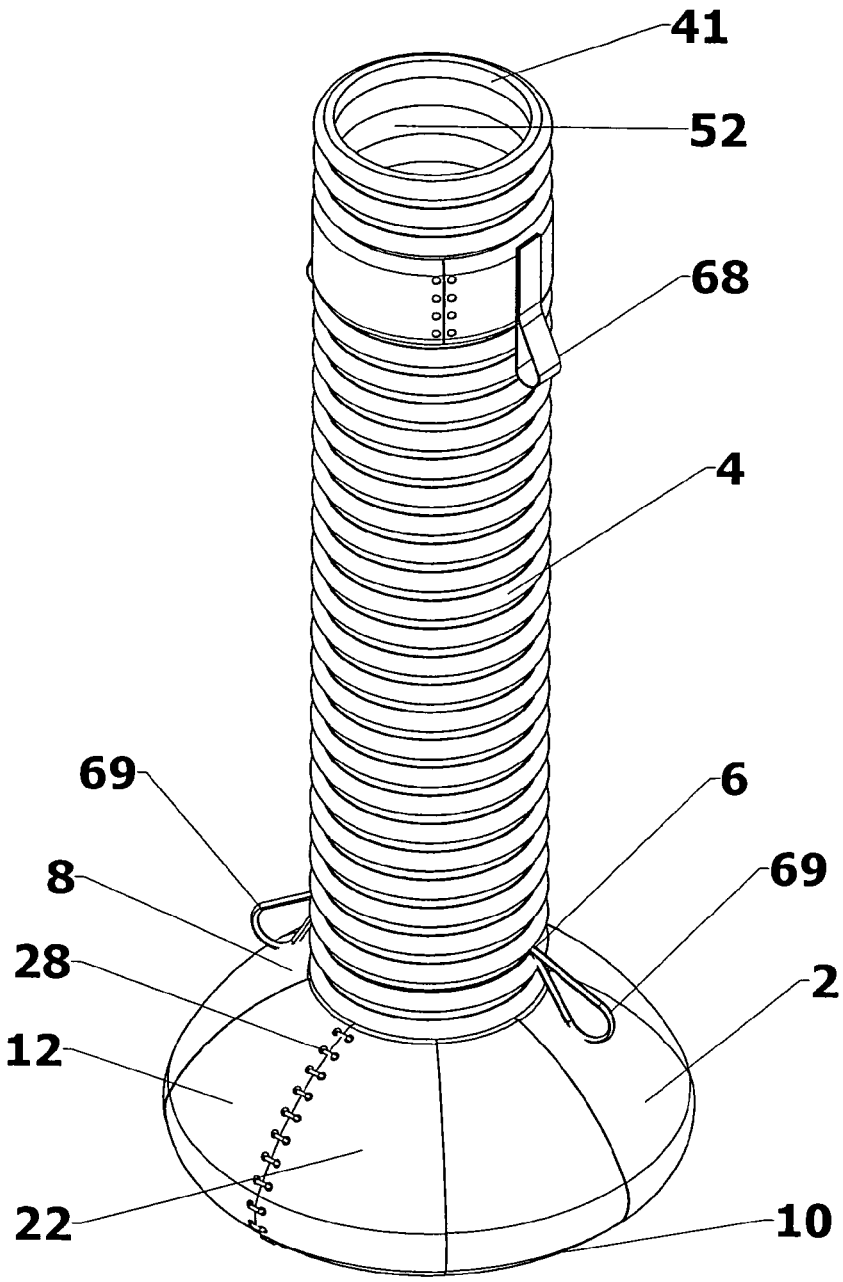
FIG. 1 illustrates a cylindrical sleeve with buoyant base in accordance with the present invention.
Figure 2:
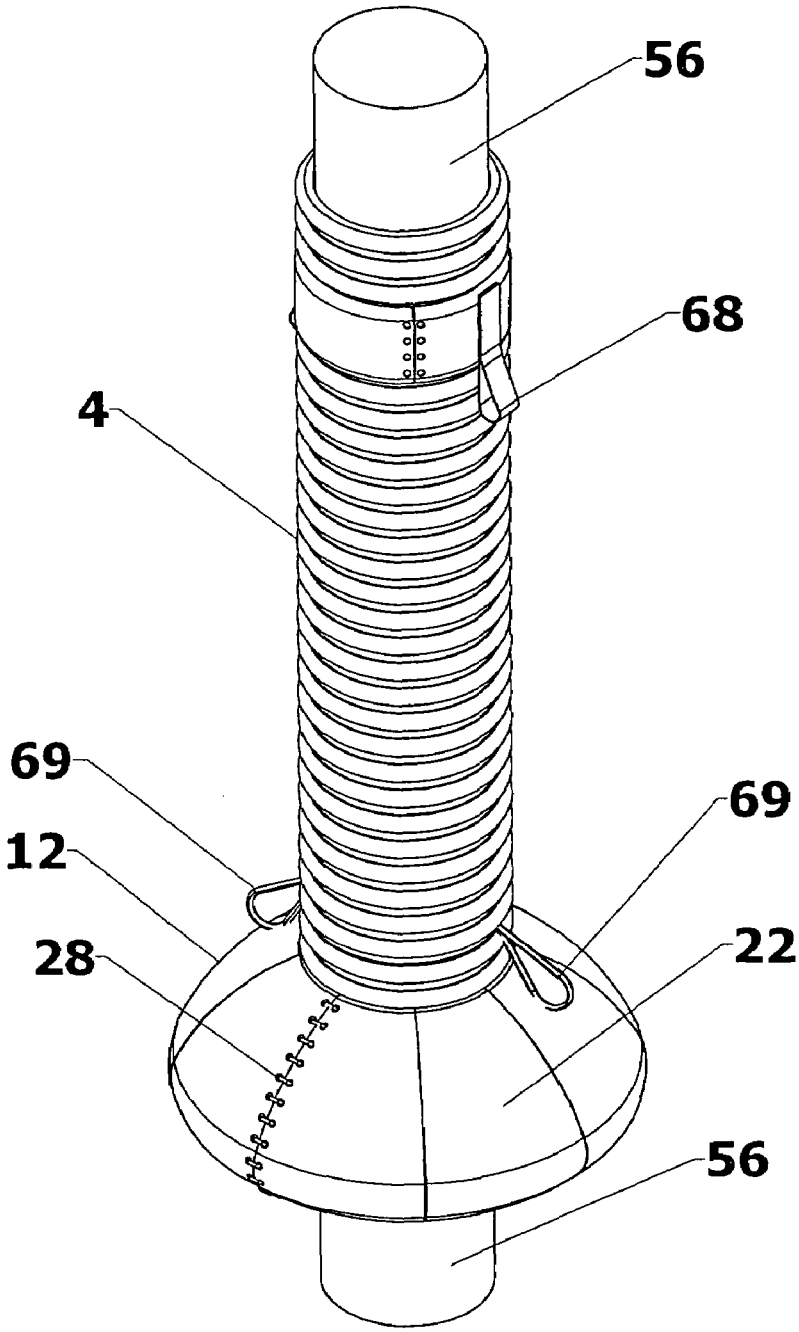
FIG. 2 is an isometric view of the cylindrical sleeve and buoyant base shown in FIG. 1 mounted upon a mooring pole.
Figure 3:
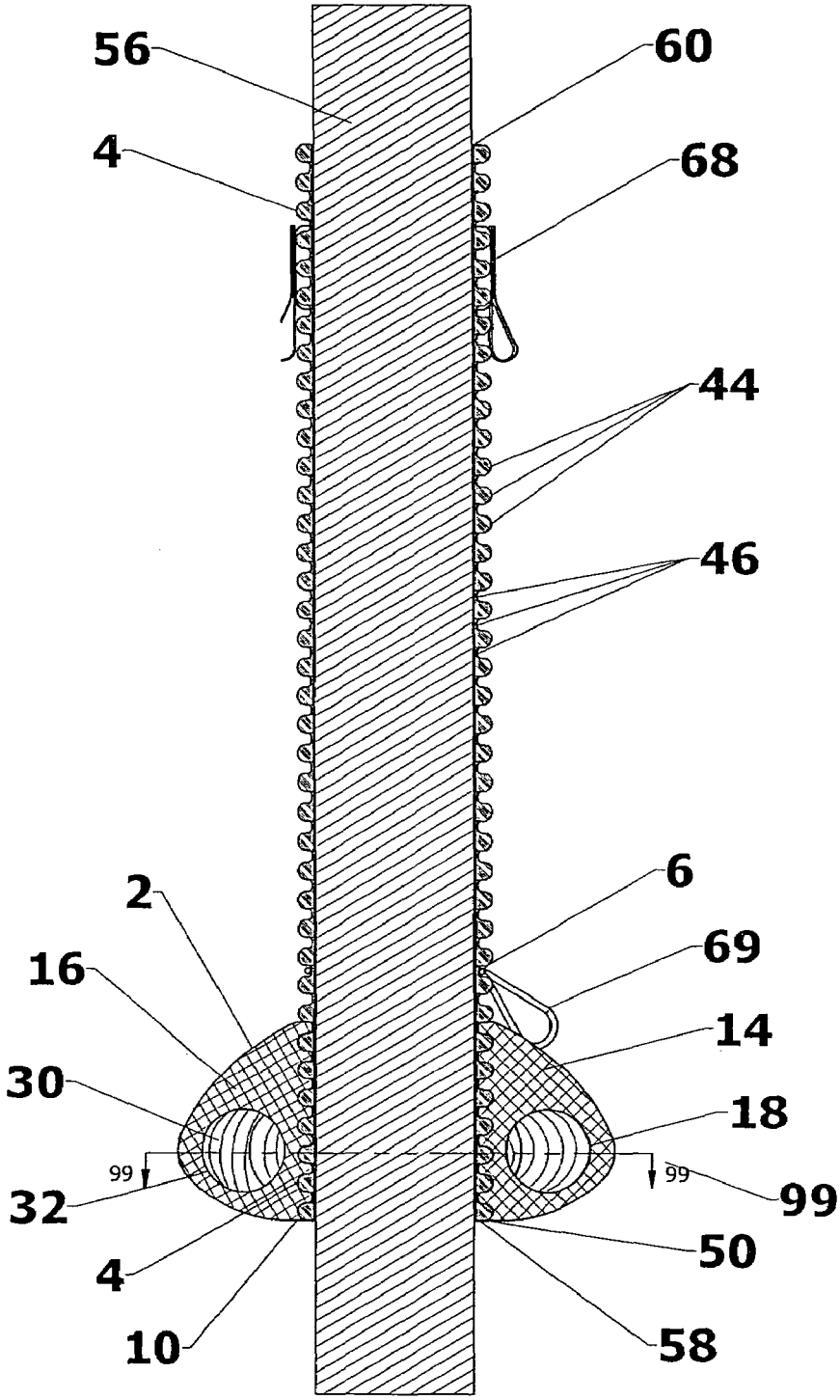
FIG. 3 illustrates a front sectional view of the sleeve and base illustrated in FIG. 3.
Figure 4:
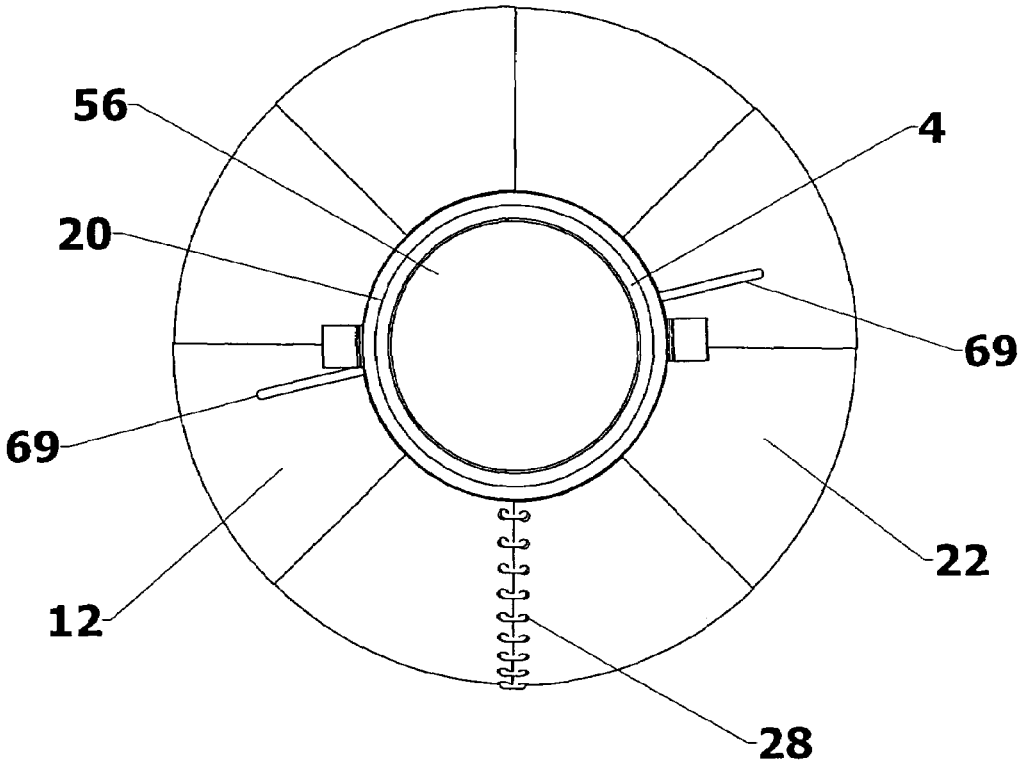
FIG. 4 illustrates a top view of the sleeve, base and pole illustrated in FIG. 2.
Figure 5:
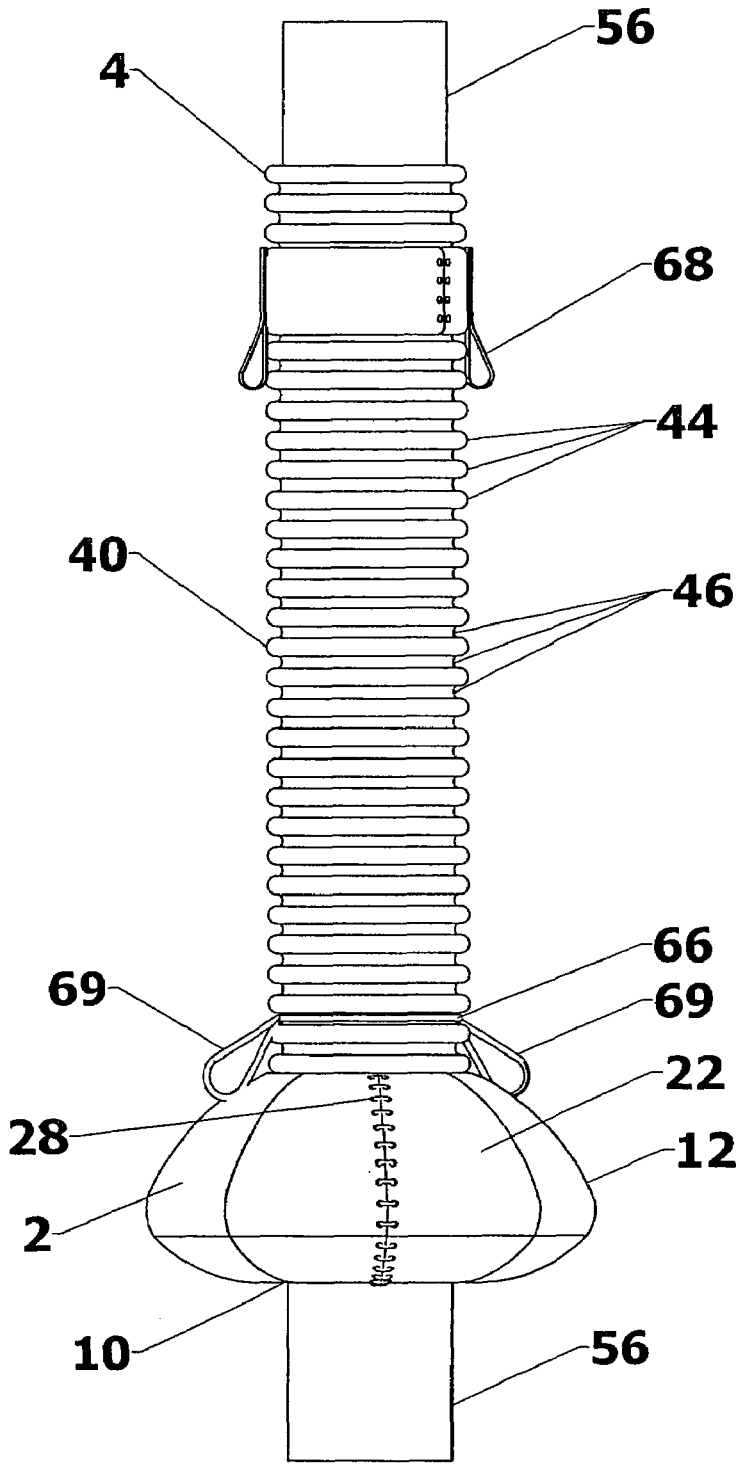
FIG. 5 is a front view of the cylindrical sleeve and buoyant base illustrated in FIG. 2.
Figure 6:
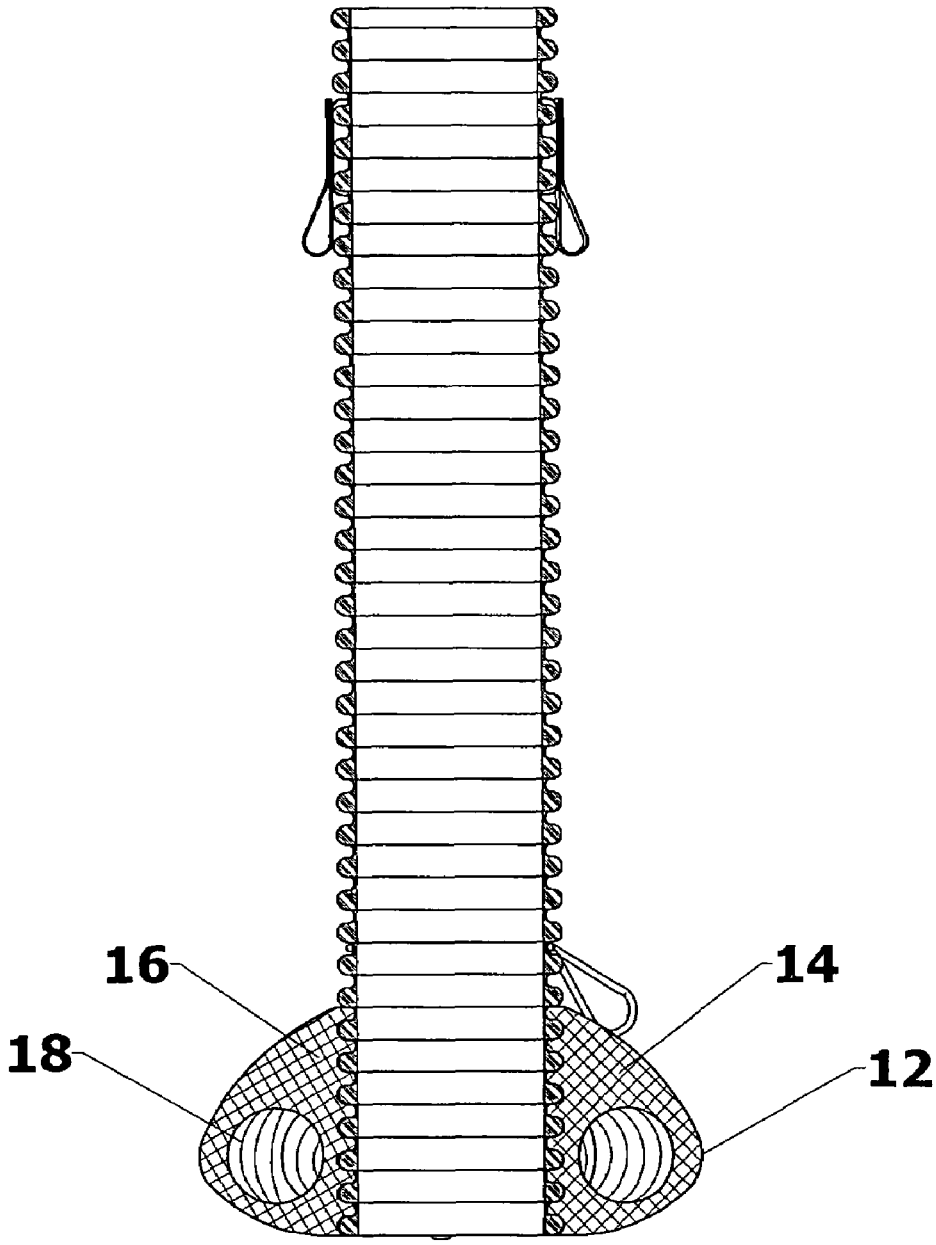
FIG. 6 is a front sectional view of the sleeve and base illustrated in FIG. 1.
Figure 7:
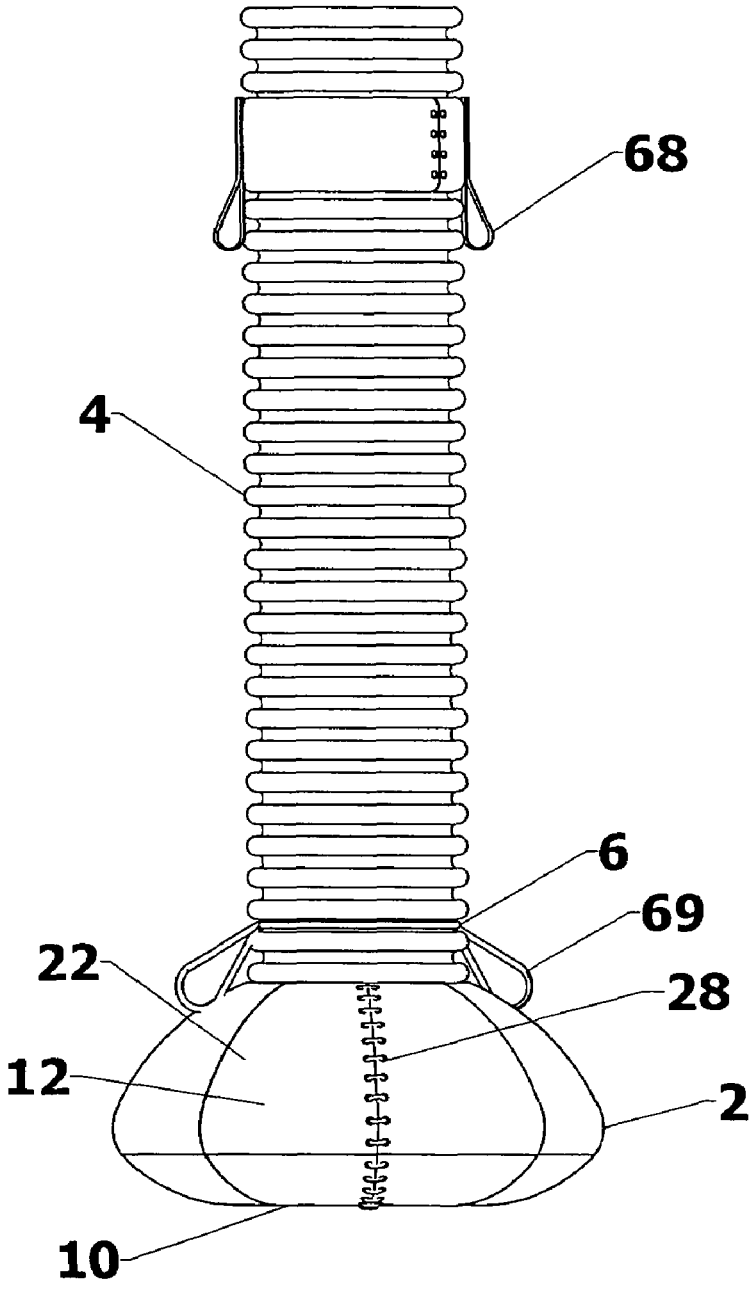
FIG. 7 is a front view of the cylindrical sleeve and buoyant base shown in FIG. 1 mounted upon a mooring pole.
Figure 8:
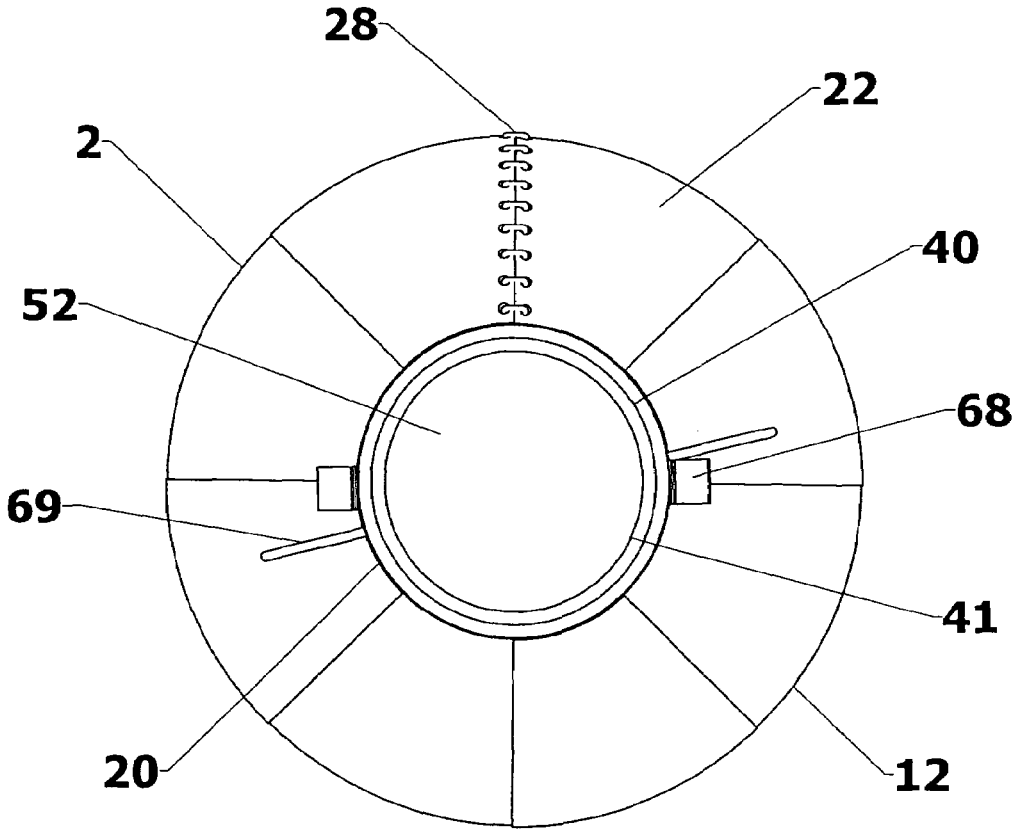
FIG. 8 is a top view of the cylindrical sleeve and base illustrated in FIG. 1.
Figure 9:
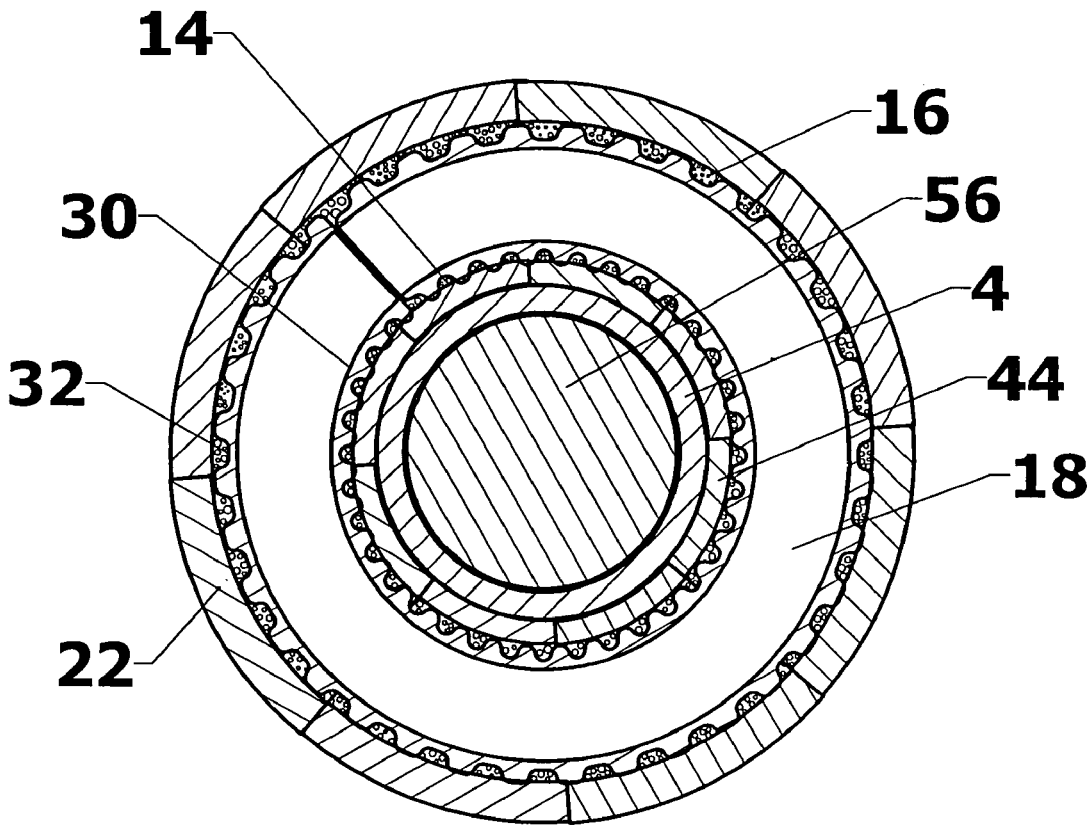
FIG. 9 is a top sectional view of cylindrical sleeve, buoyant base and mooring pole illustrated in FIG. 3 as viewed at section line 99.

The cylindrical sleeve 4 utilized in the apparatus of the present invention is a tubular structure having a proximal (or inferior) 58 and distal (or superior) 60 termini. It may advantageously include at least one line engagement means 6 which may be utilized to tie vessels to the device or as an emergency safety handhold for individuals in the water. The sleeve is configured to include a central bore 52 therewithin extending throughout the length of the sleeve. The central bore is especially configured to demonstrate a diameter sufficient to allow the bore to receive (and the sleeve to be place coaxially upon) and closely adapt to a piling 56 having a given outside diameter and length. The term "closely adapt" as utilized in regard to the coaxial fit of the sleeve upon a mooring pole refers to a relatively close adpatation of sleeve upon pile—so as to minimize lateral displacement of the sleeve away from the pile while, at the same time, providing sufficient clearance for movement—without binding—of the sleeve along the length of the pile. Such a configuration allows the cylindrical sleeve, as discussed above and below, to be coaxially slipped over a mooring pile adjacent to a floating dock and move up and down the pile with little lateral displacement from the long axis of the pile. It is preferred that, in order to achieve such close adaptation of sleeve to pile, that the inside diameter of the cylindrical sleeve be from about 1.0 inches to about 4 inches larger than the outside diameter of a pile to which it is applied. It is still further preferred that the inside diameter of the cylindrical sleeve be from about 1.5 inches to about 3 inches larger than the outside diameter of the cylindrical sleeve. The outside surface of the cylindrical sleeve is configured to include a plurality of circumferential parallel rings 44 and grooves 46. Thus, the circumferential parallel rings and grooves are oriented perpendicular to the long axis of the sleeve. It is especially advantageous to configure the cylindrical sleeves with parallel grooves running along the entire length of the cylindrical sleeve. In contrast to the outside surface 40, the inner surface 41 of the cylindrical sleeve (defining the central bore), exhibits a smooth surface to facilitate movement along the length of a mooring pile. The cylindrical sleeve may be fabricated of any marine quality material such as, for example, a polyvinyl, polyether or polyester plastic. The sleeve may be also fabricated from a natural rubber or a synthetic rubber such as, for example, a nitrile rubber.

Figure 13:
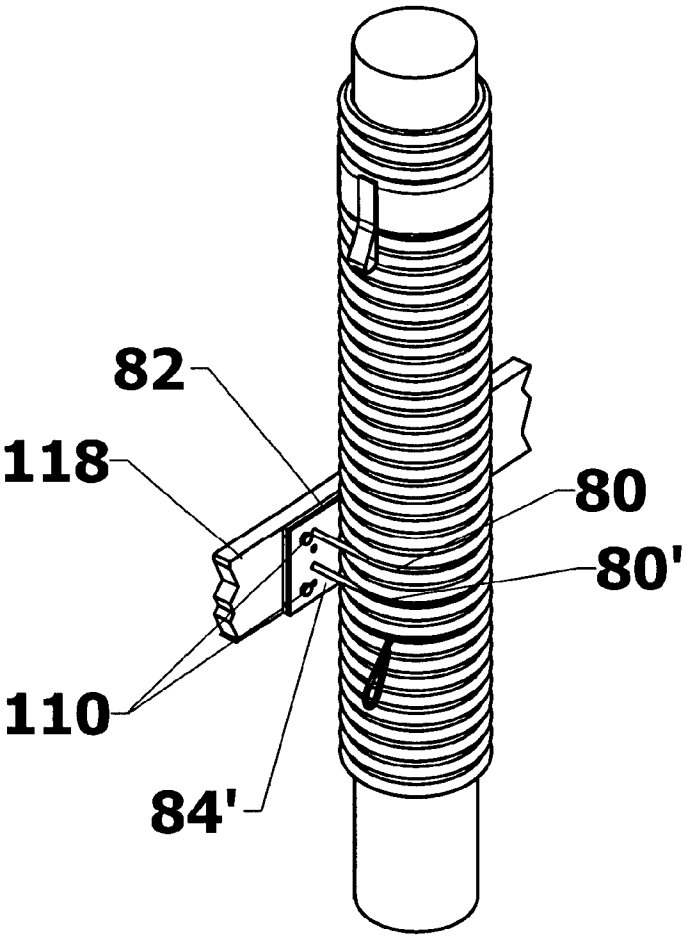
FIG. 13 is an alternate preferred embodiment of the device of the present invention wherein the cylindrical sleeve does not include a buoyant base.

In certain preferred embodiments of the present invention the apparatus further comprises a buoyant base 2, including a superior (distal) 8 and inferior (proximal) 10 terminus affixed to the cylindrical sleeve. The buoyant base can be further described as having a outer surface 12 as well as an inner core 14. The inner core is filled with a buoyant material 16, inner coil 18 and includes a central bore 20. The outer surface 12 of the buoyant base is advantageously covered by a tough resilient cover 22 suitable for marine use. Suitable materials for such a resilient cover include, for example, polyvinyl, polyester or nylon plastics as well as natural rubber or nitrile rubber compositions. Both the superior and inferior terminus of the buoyant base include a central opening contiguous with the central bore 20. However, alternate preferred embodiments of the present invention, as illustrated in FIG. 13, do not incorporate the aforementioned buoyant base.

In embodiments of the present invention incorporating a buoyant base, the outside diameter of the sleeve and the diameter of the inner bore 20 of the buoyant base are especially configured so that a proximal portion of the outer surface of the cylindrical sleeve will fit coaxially withing and mate with the central bore of the buoyant base. Such a configuration allows ease of fixation of the buoyant base to the proximal terminus of the cylindrical tube via, for example, injection and curing of polystyrene core material into the base during fabrication of the device (discussed in greater detail above and below).

The cover 22 may be fabricated of one or more sections and tied 28 (or otherwise affixed) to the outer surface 12 of the buoyant base 2. The inner core 14 of the buoyant base 2 includes an inner coil 18. The inner coil comprises a hollow tube circumferentially aligned in relation to the cylindrical sleeve having an inside 30 and outside 32 surface. The outside surface of the inner coils advantageously includes a plurality of parallel, circumferential rings and parallel grooves therebetween for enhancement of fixation of the buoyant base to the cylindrical sleeve. Thus, when assembled, the circumferential grooves and rings (also referred to, throughout this specification and within the claims as "annular rings") of the inner coil are adjacent and perpendicular to the circumferential rings 44 and grooves 46 (also referred to, collectively, as "annular rings") of the cylindrical sleeve along the length of the sleeve encircled by the buoyant base.

The inner core 14 of the buoyant base is substantially filled with a buoyant material 16—such as a cured foam material—having a density (and thus specific gravity) less than that of water. It is preferred that such buoyant materials demonstrate a specific gravity of from about 0.1 to about 60 lb/ft$^3$. However, it is still further preferred that such foam be selected to have a density of from about 1.5 to about 2.5 lb/ft$^3$. It is, in addition, highly advantageous to select a closed cell foam which, by nature, resists uptake of water. It is also highly advantageous to utilize an injection process in order to fill the buoyant base with the foam material. For this purpose, injection openings may be provided within the outer cover of the buoyant base as well as within the cylindrical sleeve, proximal to the inferior terminus thereof.

As mentioned above, the buoyant base 2 defines a substantially tubular, or, as it may be better described, a "donut-like" shape including and defining a central bore 20. The central bore 20 of the buoyant base surrounds a proximal portion of the cylindrical sleeve 4 of the device as serves as the location and interface of attachment of these two structures by means of the buoyant material which fills both the buoyant base and the annular rings of the external surface of the columnar sleeve adjacent the base. Thus, the inner bore of the buoyant base is selected to demonstrate a inside diameter sufficient to mate with the outside diameter of the cylindrical sleeve. Fixation of the buoyant base to the cylindrical sleeve may be accomplished, for example, by first introducing the inferior (proximal) terminus 50 of the cylindrical sleeve into the central bore 20 of the buoyant base until the inferior terminus of the sleeve is aligned with the inferior terminus of the base 10. However, the inferior terminus 50 of the cylindrical sleeve may be drawn past (further inferior to) the inferior terminus of the buoyant base if so desired for a particular mounting application. As mentioned above, the inner coil of the buoyant base surrounds and forms the central bore of the base. The annular rings of the outer surface of the cylindrical sleeve face are perpendicular and adjacent to annular rings of the outside surface of the inner coil of the buoyant base. Thereafter, injection points (or openings) located, for example, within the cylindrical sleeve in the vicinity of the inferior terminus thereof or within the buoyant base, allow for the injection of buoyant material through the sleeve and into the core of the buoyant base. The buoyant material substantially fills the entire core of the base, including areas between the annular rings of the inner coils as well as the areas between the annular rings of the cylindrical sleeves in contact with the core. Curing of such material thus effectively affixes the buoyant base to the sleeve.

As described above, the cylindrical sleeve is configured as a hollow tubular structure with an 40 outer surface and an 41 inner surface defining a central bore 52.

In preferred embodiments of the present invention, the buoyant material utilized to fill the core and space between the rings and grooves of the cylindrical sleeve and inner coil demonstrate, at minimum, sufficient buoyancy so as to assure that the entire length of cylindrical sleeve, superior to the superior terminus of the buoyant base, will be above the water line when the device is placed on a mooring pole—both prior and after affixing the apparatus to a dock—. Providing such buoyancy is necessary in order to expose all of the circumferential grooves on the cylindrical sleeve, superior to the buoyant base, above the water line for the most flexible positioning options. In this manner, one may select from any of the thus exposed circumferential grooves on the outer surface of the sleeve for placement of the "U" shaped arms. Such flexibility enables affixation of the base plate to docks of varying heights and configurations.

The outer surface 40 of the cylindrical sleeve is shaped and configured to include a plurality of continuous parallel rings and grooves therebetween (also referred to throughout this specification and within the claims, with equal meaning as "annular rings)—arranged circumferentially about said outer surface. In contrast, the inner surface 41 of the cylindrical sleeve defines a relatively smooth surface. The cylindrical sleeve may be fabricated of any marine quality material such as, for example, an ABS, polyvinyl, polyether, polyurethane, polypropylene, polyolefin, or polyester plastic. The sleeve may be also fabricated from a natural rubber or a synthetic rubber such as, for example, a nitrile rubber compound. The smooth inner surface of the cylindrical sleeve (and the central bore defined thereby) are especially sized and configured so as to allow the device (in embodiments of the present invention with and without a buoyant base affixed to the cylindrical sleeve) to slide easily over a mooring pole 56 without causing any damage thereto. The smooth inner surface of the cylindrical sleeve runs from the inferior 58 (or proximal) to the superior 60 (or distal) terminus of the device thereby allowing the entire device to be placed upon and slide up and down a mooring pole. As mentioned above, the annular (or parallel circumferential) grooves of the cylindrical sleeve serves two distinct purposes. During the above-described fabrication of the mooring pole device, an inferior portion of the outer surface of the sleeve is passed through the superior terminus of the central bore of the buoyant base section (prior to injection of foam therein). At this point in the fabrication process, the buoyant base includes the above-described outer cover, an inner circumferential coiled tube (similar to the columnar sleeve, but of a more diminutive diameter). The coiled tube within the base defines the central bore of the buoyant base and provides a dimension thereto sufficient so as to allow the sleeve to fit matingly therewithin, substantially flush with the proximal terminus thereof. The annular rings of the present device provide mooring line tie points of varying heights (in regard to water level) so as to accommodate boats of varying sizes and freeboard dimension. Mooring lines from such boats may be tied about a particular circumferential groove in accordance with the relative height of the boat cleat or tie point utilized. In such instances, the groove itself becomes the line engagement means. In addition, the device of the present invention may include a separate line engagement means in addition to the groove alone such as, for example, an adjustable engagement rope 66 tied circumferentially about a selected annular groove. The adjustable rope is configured to include one or more line engagement loops 69 through which mooring lines may be past in order to secure a boat. The adjustable rope is tied so as to allow it to be moved superiorly or inferiorly within selected grooves located along the outer sleeve so as to accommodate the afore-mentioned varying boat dimensions. As mentioned above, the adjustable engagement rope, and loops thereupon, may be utilized as grab handles for individuals (such as swimmers or those fallen overboard) in distress or to aid in mooring a boat.

Embodiments of the present invention incorporating the afore-mentioned buoyant base 2 may, via the buoyancy of said base, comprise a means of providing additional buoyancy to a floating dock to which the apparatus is affixed. In other embodiments, wherein a dock may not incorporate any buoyant material therewithin, the buoyancy provided by the buoyant base of the apparatus to which the dock is affixed may provide the sole means of providing floation to the dock. In addition to floatation, the buoyant base also provides further protection of the mooring pilings from collision with boats and other floating structures. However, alternate preferred embodiments of the present invention, as illustrated in FIG. 13, do not utilize or include a buoyant base. In such embodiments, floatation/buoyancy is derived solely from the floating dock and buoyant material incorporated therein.

As discussed above, the smooth inner surface of the cylindrical sleeve (and the central bore defined thereby) are especially sized and configured so as to allow the device (with or without the cylindrical sleeve being attached to a buoyant base) to slide easily over a mooring pole 56. The smooth inner surface of the cylindrical sleeve runs from the proximal (or inferior) to the distal (or superior) terminus of the device thereby allowing the entire device to be placed upon and slide coaxially, along the length of a mooring pole.

The parallel grooves 46 formed upon the external surface of the cylindrical sleeve serve two purposes. Firstly, the grooves form engagement sites for receipt of the at least two "U" shaped arms 80 & 80' of the dock mooring bracket (discussed in detail both above and below). Secondly, the circumferential grooves also provide points for attachment of mooring lines to boats moored alongside a floating dock utilizing mooring piles upon which the apparatus of the present invention is placed for mooring of the floating dock (rather than tying such boats to the floating dock). The parallel rings and grooves are, of course, parallel in configuration to each other and are aligned perpendicular to the long axis of the sleeve.

The dock mooring bracket is comprised of at least two "U" shaped arms 80 & 80', a base plate 82, a means of affixing the arms to the plate and a means of affixing the base plate to a floating dock. The base plate may be described as having an inside face (or "inner face") 84 and an outside face (or "outer face") 84'. The inside face of the base plate is that surface of the plate mounted upon and in contact with a portion of a floating dock to which the bracket is affixed (as discussed in more detail, below). The outside face of the bracket is that surface of the base plate ordinarily facing and in contact with a cylindrical sleeve to which the bracket is mounted. It is highly advantageous, in embodiments of the present invention wherein the "U" shaped bolts are affixed to the base plate via nuts and washers, to form a recess—a bolt recess 86—within the inside face of the base plate so, as described in greater detail below, to allow the termini of the "U" shaped brackets to be affixed to the plate with nuts and bolts without either the termini of the brackets themselves or fasteners (nuts and bolts) from extending therefrom to also extend beyond the surface of the inside face. This arrangement facilitates flush mounting of the base plate to a relatively flat dock mounting surface.

It is also preferred that the at least two "U" shaped arms also be fabricated of a corrosion resistant or non-corroding metal such as, for example, galvanized steel, aluminum or stainless steel.

The base plate may be advantageously configured as a square or rectangular shaped plate (having a relatively flat profile) fabricated of any of the above-mentioned materials. However, the base plate may also be formed in other shapes in order to allow the plate to be securely placed against and secured to a floating dock. The base plate is configured to include at least two and preferably four anchor bolt receiving holes 88 passing therethrough for receipt of anchor bolts, or screws or other fastening devices utilized as the means of affixing the base plate to the floating dock. It is preferred that these affixing means also be fabricated from a corrosion resistant metal such as, for example, galvanized steel, brass or stainless steel.

Figure 10A:
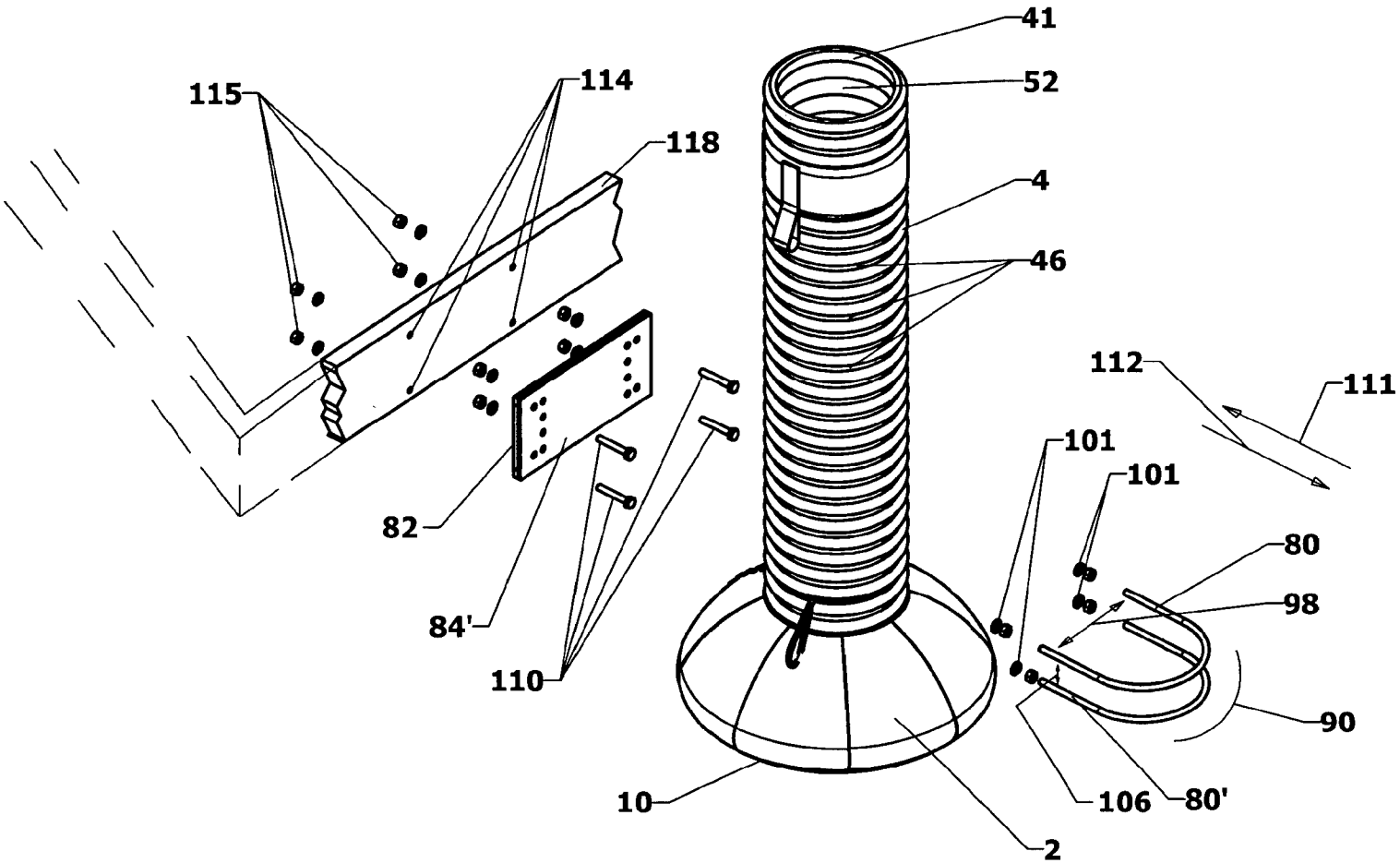
FIG. 10*a* is an exploded isometric view of a preferred embodiment of the dock mooring device of the present invention.
Figure 10B:
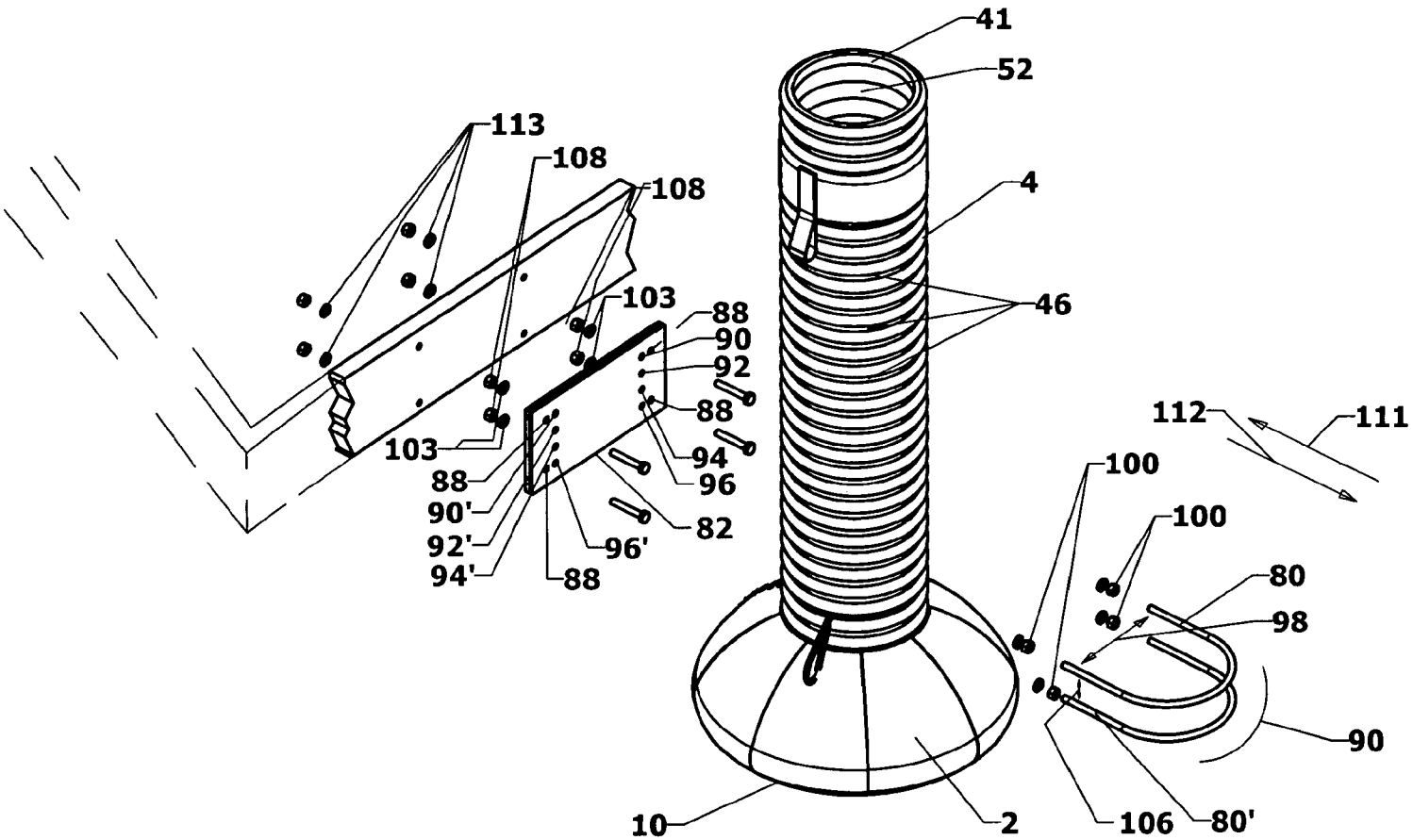
FIG. 10*b* is an exploded isometric view of the same preferred embodiment illustrated in FIG. 10*a* including additional number references.
Figure 11:
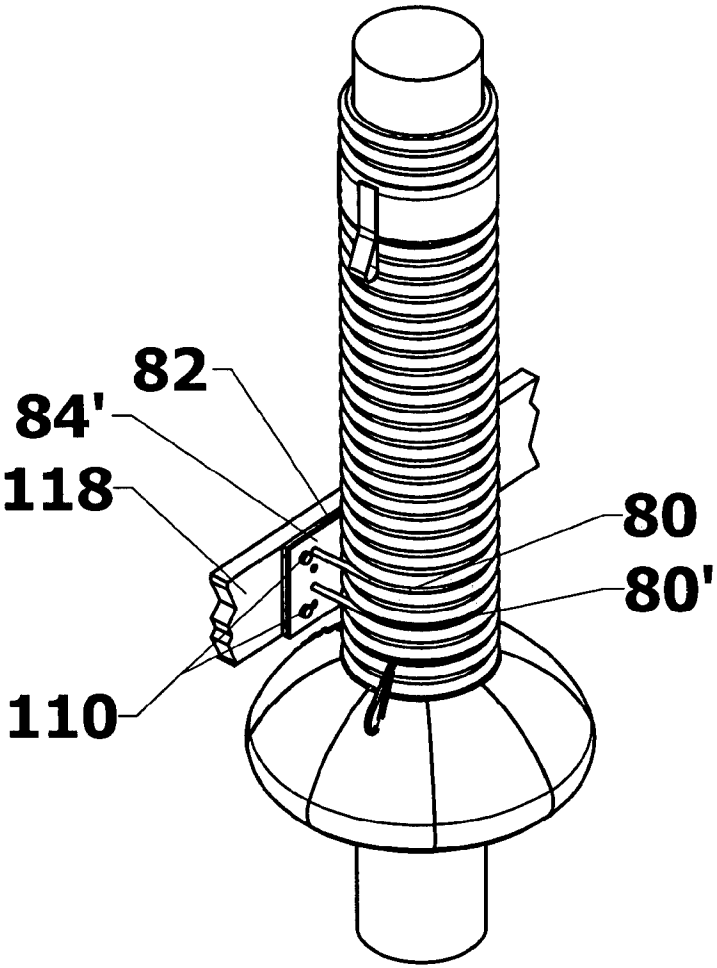
FIG. 11 is an isometric view of a preferred embodiment of the dock mooring device of the present invention illustrated in FIG. 10.
Figure 12:
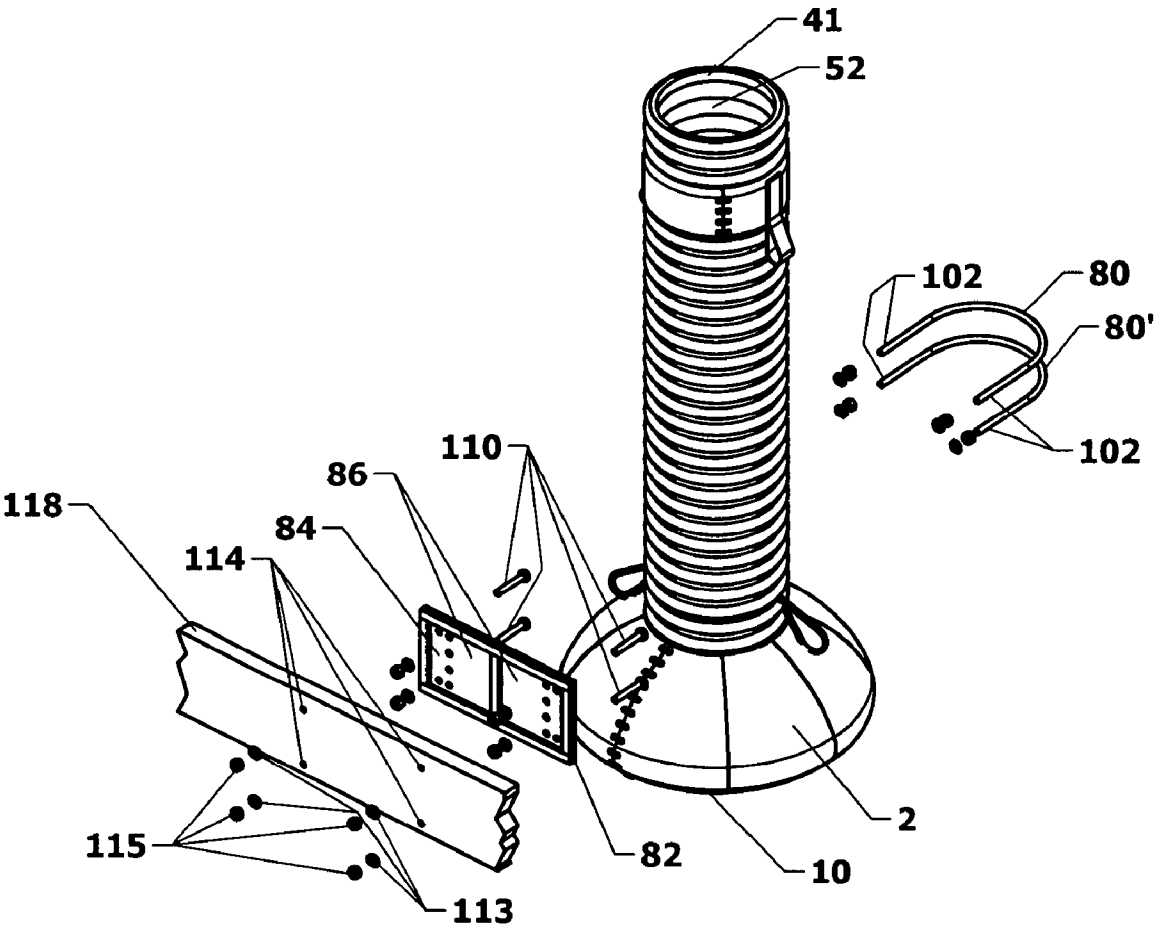
FIG. 12 is a rear exploded isometric view of the preferred embodiment of the dock mooring device of the present invention illustrated in FIG. 10.

In preferred embodiments of the present invention, the base plate also includes at least two pairs of "U" shaped arm receiving holes (four pairs illustrated at 90/90', 92/92', 94/94' & 96/96') provided as a means of mounting the at least two "U" shaped arms (discussed below), to the base plate. The bracket may include, as shown in FIGS. 10-12, additional pairs of "U" shaped arm receiving holes in order to provide greater flexibility in selection of bracket mounting positions piling upon which it is placed during changes in tide level. The "U" shaped arm receiving holes are especially positioned so that each pair (e.g. 90/90', 92/92', 94/94' & 96/96) receives two termini of the same "U" shaped arm. They are positioned and configured so that an imaginary line running from the center of each member of any pair of "U" shaped arm receiving holes is parallel to such an imaginary line connecting any other pair of "U" shaped arm receiving holes. The "U" shaped arm receiving holes are further configured so that the distance between an imaginary line running from the center of the bore of each member of a pair of arm receiving holes and another imaginary line running from and between the center of the bores of any other pair is equal to the distance between adjacent parallel grooves of the cylindrical sleeve (or a whole number multiple thereof. In this way, the receiving holes are configured to assure that "U" shaped brackets mounted thereupon will align with and mount within selected circumferential grooves of the cylindrical sleeve.

As discussed above, the mooring bracket includes at least two "U" shaped arms 80 & 80' especially configured and adapted to engage at least two circumferential parallel grooves 46 of the cylindrical sleeve. Thus, the at least two "U"

shaped arms are configured, arranged and mounted upon the base plate in such a manner as to enable engagement of two adjacent parallel grooves of the cylindrical sleeve. However, the present invention contemplates embodiments wherein the at least two "U" shaped arms are configured, arranged and mounted upon the base plate in such a manner as to engage parallel, but non-adjacent parallel grooves as well (wherein interceding grooves of the cylindrical sleeve intervene between grooves engaged by the "U" shaped arms.

The "U": shaped arms may be described as terminating with two termini and include, at a portion of the arms therebetween, a curved "semi-circular" portion 90. In preferred embodiments of the present invention, the termini 102 of the "U" shaped arms are externally threaded as a means for engagement to the base plate. However, it is also contemplated, in other alternate embodiments of the present invention, that the termini of the "U" shaped arms are affixed directly to the base plate via bonding, welding or one-piece construction wherein the "U" shaped arms and base plate are fabricated as one continuous unit.

As discussed above, the at least two "U" shaped arms are affixed to the base plate in such a manner and in such an orientation as to enable the at least two "U" shaped arms to engage either adjacent or non-adjacent circumferential parallel grooves of the cylindrical sleeve. Thus, the "U" shaped arms are mounted, upon the base, in such a manner as to position the "U" shaped arms parallel to one another. When mounted tightly upon a base plate, the two or more "U" shaped arms mounted thereupon will lie parallel to each other and the intervening space 106 therebetween will be substantially equal to the space between two parallel—but not necessarily adjacent—grooves of the cylindrical sleeve within which they are mounted.

The "U" shaped arms are formed to demonstrate an inside diameter 98, that allows the "U" shaped arms to closely adapt to, engage and lie within the parallel grooves of the cylindrical sleeve. As discussed above, the close adaptation of the "U" shaped arms within the grooves of the cylindrical sleeve, in combination with the parallelism achieved between water surface, the spaced apart "U" shaped arms and the parallel grooves of the cylindrical sleeve enables the apparatus of the present invention to provide great stability to a dock utilizing such apparatus for mooring as against listing in reaction to water movement.

In the preferred embodiment of the present invention, the at least two "U" shaped arms are affixed to the mounting plate via conventional nuts (four shown at 100, and four shown at 108) and washers 101. In such embodiments, "U" shaped arm receiving holes (90/90', 92/92', 94/94' & 96/96) provided within the mounting plate and are positioned so as to receive the two free end termini 102 of each "U" shaped arms. In such embodiments, the two termini 102 of the "U" shaped arms include external threads for mating engagement of both screw-type fasteners such as, for example, nuts as well as non-screw type fasteners such as, for example, washers. More specifically, in one such preferred embodiment of the present invention, the external threads of the two proximal termini of the "U" shaped arms are engaged with corresponding nut fasteners 100 (four illustrated) followed by a washer 101 (four shown) prior to passing the proximal termini through corresponding "U" shaped arm receiving holes and, after passing through said receiving holes, an additional washer 103 and nut 108 is affixed to said termini so as to firmly engage each arm to the bracket.

Utilizing at least two "U" shaped arms, distanced apart, one from another, and disposed in a parallel relation, one to another in combination with tight mating engagement of the arms with circumferential grooves of the sleeve provides great resistance to the listing of floating docks secured to a mooring pole by the apparatus of the present invention. Further dock stability is provided by configuring the inside diameter of the cylindrical sleeve and selecting mooring poles upon which to mount such sleeves so as to provide close, but non-binding engagement of the sleeve upon the pile. In this manner, the sleeve is able to move up and down the pile with tide changes without binding—the inner surface of the sleeve being smooth—. Thus, affixation of the bracket to the dock with parallel, tightly fitting and spaced apart "U" shaped arms in combination with close adaptation of the cylindrical sleeve to a mooring pole provides maximum stability against listing to a dock which is moored to a pile utilizing the apparatus of the present invention.

In embodiments of the present invention wherein externally threaded "U" shaped arms are affixed to the mounting plate via washers and nuts, the pile capture area defined by the area within and bordered by the "U" shaped arms and base plate may be easily adjusted by simply rotating the subject nuts proximally, in the direction of arrow 111, to increase the area (to loosen the bracket's engagement of the sleeve), and distally in the direction of arrow 112, to reduce the area (and increase the bracket's engagement of the sleeve).

As discussed above, the aforementioned procedure for affixing the dock mooring to a cylindrical sleeve may be utilized either before or after the central bore of the cylindrical sleeve is placed over a piling utilized for mooring a floating dock. In addition, the aforementioned assembly procedure is equally applicable to embodiments of the present invention wherein the cylindrical sleeve is affixed to a buoyant base as well as embodiments in which a buoyant base is not utilized.

The base plate includes two, and preferably four or more anchor bolt receiving holes 88 & 88' for receipt of anchoring means. More specifically, the means for affixing the bracket to a floating dock may include machine bolts, lag bolts, U bolts, screws or any combination thereof wherein such fasteners are passed through the anchor bolt receiving holes and thereafter are affixed to suitably prepared receiving holes provided within the structure of the floating dock itself. For example, properly sized and placed pilot holes may be prepared within the material comprising the floating dock. Thereafter, a lag bolt may be passed through each of the anchor bolt receiving holes of the base plate and thereafter be driven into the pilot holes. However, it is preferred that bolt receiving holes 114 are prepared within the floating dock and thereafter machine bolts 110 are passed through each of the anchor bolt receiving holes 88 & 88' of the base plate and through the bolt receiving holes prepared in a structurally sound portion of the dock such as, for example a face plate 118. Thereafter, conventional washers 113 and nuts 115 are utilized to secure the bolts, and the brackets to which they are attached, to the floating dock.

The base plate may, as discussed above, now be affixed to the floating docks utilizing lag bolts, machine bolts, U bolts or other fasteners which pass through the at least two and preferably 4 anchor bolt receiving holes of the base plate to engage the portion of floating dock upon which the bracket is mounted. However, it is preferred that any such fasteners be fabricated of corrosion resistant or non-corroding materials such as, for example, stainless steel, galvanized steel or brass.

As mentioned above, certain preferred embodiments of the present invention include a buoyant base affixed proximate to the inferior terminus of the cylindrical sleeve. The buoyant base is tubular in configuration and includes an outer surface and an internal core surrounding and defining a central bore.

The core of the buoyant base includes an inner circumferential coiled tube—an inner coil—(similar to the columnar sleeve, but of a more diminutive diameter and forming a closed circle). The inner coil includes an outer surface which is configured to demonstrate parallel grooves and rings similar to that found upon the outer surface of the cylindrical sleeve.

The inner coil is coiled about (circumscribes) and forms what may be described as the central bore of the buoyant base. This central bore is configured to have a dimension sufficient so as to a proximal portion of the cylindrical sleeve to fit therewithin. The inner coil is thus disposed circumferentially and perpendicular to the cylindrical sleeve. In this configuration, a portion of the parallel rings and grooves formed on the surface of the inner coil of the buoyant base are in contact with and aligned generally perpendicular to the parallel rings and grooves of that portion of the cylindrical sleeve passing through the bore of the buoyant base.

The outer surface of the buoyant base is advantageously covered by a tough, resilient cover, such as, for example, a polyvinyl, polyester or nylon composition. The cover may be fabricated of one or more sections and tied (or otherwise affixed) to the outer surface of the buoyant base. The inner core of the buoyant base is comprised of a buoyant structure such as, for example, a circumferential polyethylene, polyvinyl or polyester hollow tube positioned within the core. Additionally, the core of the buoyant base is filled with a buoyant material such as, for example, a polystyrene foam thereby imparting great buoyancy to the base.

In embodiments of the present invention including a buoyant base, it is preferred—but not required—that the buoyant base be located from about 2 to about 5 feet from the inferior terminus of the sleeve. This configuration allows the buoyant base to aid in enhancing the buoyancy of the floating dock to which the cylindrical sleeve is affixed while, simultaneously serving as an additional shock absorber between dock and piling.

As mentioned above, the apparatus of the present invention is especially configured for floating docks wherein the height of the dock, relative to adjacent pilings, is subject to change in accordance with changing tides, water levels, etc. As also mentioned above, the present invention also provides, with embodiments incorporating a buoyant base mounted upon the cylindrical sleeve, a means of increasing dock buoyancy to a floating dock as well as providing buoyancy to a dock not including, as an integral part of such dock, a buoyancy means sufficient to provide suitable floatation thereto.

The inner bore diameter of the coaxially mounted cylindrical sleeve allows the sleeve to easily move up and down a mooring pile upon which it is placed, changes in water levels, causing a floating dock moored to a piling by means of the apparatus of the present invention, results in a simple, relatively smooth and non-traumatic upward and downward traverse of the sleeve along the pile. The apparatus of the present invention thereby avoids listing, capsizing and other disturbances caused to floating docks by other means of anchoring same to piles. In addition, engagement of two or more parallel groove of the cylindrical sleeve the two or more "U" shaped arms of the mooring bracket greatly reduces listing of the floating dock due to wave/wake action or uneven loading of the dock. Since, as described in greater detail below, the two or more "U" shaped arms are firmly engaged, on a distal portion thereof, within parallel grooves of a coaxially placed cylindrical sleeve and, on a proximal portion thereof, to a base plate of the bracket firmly bolted to the dock, the bracket slips listing of the floating dock.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the following claims.

I claim:

1. An apparatus for affixing a floating dock to a mooring pole comprised of:

a cylindrical sleeve, a mooring bracket and a means for affixing the mooring bracket to a dock wherein the cylindrical sleeve is a tubular structure including a superior terminus, an inferior terminus, a length, an outer surface, an outside diameter and an inner surface surrounding a central bore demonstrating an inside diameter, wherein the inner surface of said sleeve is substantially smooth and the inside diameter is selected to enable the sleeve to be placed coaxially upon and closely adapt to a mooring pole of a given outside diameter while enabling said cylindrical sleeve to move up and down along said pole without binding thereto and wherein the outer surface of the sleeve includes a plurality of parallel circumferential rings, said rings defining parallel circumferential grooves therebetween, and the mooring bracket is comprised of a base plate and at least two "U" shaped arms which are affixed thereto, the base plate including at least two anchor bolt receiving holes therewithin especially configured and positioned for receiving the means of affixing the bracket to a dock, said plate further including at least two pairs of "U" shaped arm receiving holes, wherein the at least two pairs of "U" shaped arm receiving holes are so positioned and aligned within the base plate so that when the at least two "U" shaped arms are positioned and affixed to the base plate therethrough and thereby, said arms are held in a parallel relation, one to another, and distanced apart, one from another, so as to enable the at least two arms to align with, securely mate with selected circumferential grooves of the cylindrical sleeve;

wherein when said apparatus is affixed to a floating dock, the close adaptation of said cylindrical sleeve to said pole in combination with the mating engagement of the at least two "U" shaped parallel and spaced apart arms, said apparatus provides stabile mooring of the floating dock and resistance against dock listing in reaction to disturbance of water in which the dock is positioned.

2. The apparatus of claim 1 wherein the base plate includes an inner face and an outer face.

3. The apparatus of claim 2 wherein the inner face of the base plate includes a bolt recess.

4. The apparatus of claim 1 wherein the "U" shaped arms include two termini.

5. The apparatus of claim 4 wherein the termini of each of said at least two "U" shaped arms are welded to the base plate at said pair of "U" shaped arm receiving holes.

6. The apparatus of claim 4 wherein a portion of the "U" shaped arms adjacent to the termini thereof are shaped and configured to include threads especially adapted for mating engagement of fasteners utilized to secure the arms to the base plate via the "U" shaped arm receiving holes.

7. The apparatus of claim 6 wherein the fasteners utilized to secure the arms to the base plate are nuts and washers.

8. The apparatus of claim 1 wherein the means for affixing the base plate to a dock is selected from the group consisting of bolts and screws.

9. The apparatus of claim 8 wherein the means for affixing the base plate to a dock is fabricated from a corrosion resistant material.

10. The apparatus of claim 9 wherein the corrosion resistant material is elected from the group consisting of galvanized steel, brass and stainless steel.

11. The apparatus of claim 1 wherein the base plate is fabricated from a corrosion resistant metal.

12. The apparatus of claim 11 wherein the corrosion resistant metal is selected from the group consisting of galvanized steel, brass and stainless steel.

13. The apparatus of claim 1 wherein the base plate is fabricated from a composite material.

14. The apparatus of claim 1 wherein the at least two "U" shaped arms are fabricated from a corrosion resistant metal.

15. The apparatus of claim 14 wherein the corrosion resistant metal is selected from the group consisting of galvanized steel, brass and stainless steel.

16. The apparatus of claim 1 wherein said apparatus further comprises a buoyant base, said buoyant base including an outer surface, an inner surface surrounding a central bore, a superior terminus, an inferior terminus and a core and wherein said central bore demonstrates an inside diameter especially configured to enable a portion of the cylindrical sleeve, adjacent to an inferior terminus thereof, to be inserted within said bore and wherein said core is filled with a buoyant material having a specific gravity less than that of water and providing sufficient buoyancy to the apparatus so as to enable an entire length of the cylindrical sleeve, superior to the superior terminus of the buoyant base, to lie above a water line.

17. The apparatus of claim 16 wherein the outside diameter of the cylindrical sleeve is especially configured so as to enable a portion of the cylindrical sleeve, adjacent to the inferior terminus thereof, to be inserted within the central bore of the buoyant base, said buoyant material also filling a space located between the outside surface of that portion of the cylindrical sleeve inserted within the central bore of the buoyant base and the inner surface of the buoyant base so as to affix said buoyant base to said cylindrical sleeve.

18. The apparatus of claim 17 wherein the buoyant base includes an inner coil.

19. The apparatus of claim 18 wherein the inner coil includes parallel circumferential rings and grooves on an outer surface thereof.

20. The apparatus of claim 19 wherein the parallel rings and circumferential grooves adjacent the inferior terminus of said cylindrical sleeve are adjacent to and disposed in a perpendicular relation to the parallel rings and grooves of the inner coil adjacent to the central bore thereof, said buoyant material also filling the parallel grooves of the cylindrical sleeve so as to further affix said buoyant base to said cylindrical sleeve.

21. The apparatus of claim 16 wherein said buoyant material is a plastic foam material.

22. The apparatus of claim 21 wherein the plastic foam material is selected from the group consisting of thermal plastic foams including polystyrene, polyvinylchloride, polyethylene, polypropylene and ABS plastic.

23. The apparatus of claim 21 wherein said plastic foam material comprises a closed foam material.

24. The apparatus of claim 23 wherein said closed plastic foam material demonstrates a density of from about 0.1 to about 60 $lb/ft^3$.

25. The apparatus claim 24 wherein said closed plastic foam material demonstrates a density of from about 1.5 to about 2.5 $lb/ft^3$.

26. The apparatus claim 16 wherein the buoyant base includes an outer cover.

27. The apparatus of claim 26 wherein the outer cover of the buoyant base is fabricated from a plastic material.

28. The apparatus of claim 27 wherein the plastic material from which the outer cover is fabricated is selected from the group including polyvinyl, polyolefin, polypropylene, polyester, polyurethane or nylon material.

29. The apparatus of claim 26 wherein the outer cover of the buoyant base is fabricated from a rubber compound.

30. The apparatus of claim 29 wherein the rubber compound is selected from the group comprising natural rubber and nitrile rubber compounds.

31. The apparatus of claim I wherein the cylindrical sleeve is comprised of a plastic material.

32. The apparatus of claim 31 wherein the plastic material is selected from the group comprised of ABS, polyvinyl, polyether, polyurethane, polypropylene, polyolefin, or polyester plastics.

33. The apparatus of claim 1 wherein the cylindrical sleeve is comprised of a rubber compound.

34. The apparatus of claim 33 wherein the rubber compound is selected from natural and nitrile rubber compounds.

* * * * *